US009976360B2

(12) United States Patent
Wassell et al.

(10) Patent No.: US 9,976,360 B2
(45) Date of Patent: May 22, 2018

(54) SYSTEM AND METHOD FOR DAMPING VIBRATION IN A DRILL STRING USING A MAGNETORHEOLOGICAL DAMPER

(75) Inventors: Mark Ellsworth Wassell, Houston, TX (US); Daniel E. Burgess, Portland, CT (US); Jason R. Barbely, East Islip, NY (US); Fred Lamar Thompson, Somers, CT (US)

(73) Assignee: APS TECHNOLOGY, INC., Wallingford, CT (US)

( * ) Notice: Subject to any disclaimer, the term of this patent is extended or adjusted under 35 U.S.C. 154(b) by 609 days.

(21) Appl. No.: 13/228,376

(22) Filed: Sep. 8, 2011

(65) Prior Publication Data

US 2012/0085581 A1 Apr. 12, 2012

Related U.S. Application Data

(63) Continuation-in-part of application No. 12/398,983, filed on Mar. 5, 2009, now Pat. No. 8,087,476.

(51) Int. Cl.

| | |
|---|---|
| ***E21B 7/00*** | (2006.01) |
| ***E21B 17/07*** | (2006.01) |
| *E21B 44/00* | (2006.01) |

(52) U.S. Cl.

CPC ..... *E21B 17/07* (2013.01); *E21B 17/073* (2013.01); *E21B 44/005* (2013.01)

(58) Field of Classification Search

CPC ..... E21B 17/073; E21B 44/005; E21B 44/00; E21B 17/07

USPC ..... 175/40, 320, 321, 323; 166/66.5, 66.6; 188/267.1; 267/125, 137

See application file for complete search history.

(56) References Cited

U.S. PATENT DOCUMENTS

| | | | |
|---|---|---|---|
| 3,782,464 | A | 1/1974 | Quichaud et al. |
| 3,827,491 | A | 8/1974 | Dinning |
| 3,947,008 | A | 3/1976 | Mullins |

(Continued)

FOREIGN PATENT DOCUMENTS

| | | | |
|---|---|---|---|
| CA | 2754204 | A1 | 3/2010 |
| CN | 101828000 | | 9/2010 |

(Continued)

OTHER PUBLICATIONS

"Magnetic Ride Control," GM Tech Links, 4:1, pp. 1-2, Jan. 2002.

(Continued)

*Primary Examiner* — Nicole Coy
(74) *Attorney, Agent, or Firm* — Baker & Hostetler LLP

(57) ABSTRACT

A system for damping vibration in a drill string can include a magnetorheological fluid valve assembly having a supply of a magnetorheological fluid. A remanent magnetic field is induced in the valve during operation that can be used to provide the magnetic field for operating the valve so as to eliminate the need to energize the coils except temporarily when changing the amount of damping required. The current to be supplied to the coil for inducing a desired magnetic field in the valve is determined based on the limiting hysteresis curve of the valve and the history of the magnetization of the value using a binary search methodology. The history of the magnetization of the valve is expressed as a series of sets of current and it resulting magnetization at which the current experienced a reversal compared to prior values of the current.

27 Claims, 29 Drawing Sheets

(56) References Cited

U.S. PATENT DOCUMENTS

| | | | | |
|---|---|---|---|---|
| RE29,526 | E | 1/1978 | Jeter | |
| 4,133,516 | A | 1/1979 | Jurgens | |
| 4,171,025 | A | 10/1979 | Bassinger | |
| 4,387,885 | A | 6/1983 | Bishop et al. | |
| 4,416,339 | A | 11/1983 | Baker et al. | |
| 4,427,079 | A | 1/1984 | Walter | |
| 4,439,167 | A | 3/1984 | Bishop et al. | |
| 4,630,809 | A | 12/1986 | Duckworth | |
| 4,637,479 | A | 1/1987 | Leising | |
| 4,647,853 | A | 3/1987 | Cobern | |
| 4,732,211 | A | 3/1988 | Haugen et al. | |
| 4,761,889 | A | 8/1988 | Cobern et al. | |
| 4,779,852 | A | 10/1988 | Wassell | |
| 4,813,274 | A | 3/1989 | DiPersio et al. | |
| 4,894,923 | A | 1/1990 | Cobern et al. | |
| 4,994,122 | A | 2/1991 | DeBold et al. | |
| 5,034,929 | A | 7/1991 | Cobern et al. | |
| 5,133,419 | A | 7/1992 | Barrington | |
| 5,251,708 | A | 10/1993 | Perry et al. | |
| 5,332,048 | A | 7/1994 | Underwood et al. | |
| 5,366,623 | A | 11/1994 | Clair | |
| 5,382,373 | A | 1/1995 | Carlson et al. | |
| 5,398,917 | A | 3/1995 | Carlson et al. | |
| 5,421,421 | A | 6/1995 | Appleton | |
| 5,454,943 | A | 10/1995 | Ashton et al. | |
| 5,484,029 | A | 1/1996 | Eddison | |
| 5,529,133 | A | 6/1996 | Eddison | |
| 5,553,678 | A | 9/1996 | Barr et al. | |
| 5,617,926 | A | 4/1997 | Eddison et al. | |
| 5,638,910 | A | 6/1997 | Noe et al. | |
| 5,685,379 | A | 11/1997 | Barr et al. | |
| 5,695,015 | A | 12/1997 | Barr et al. | |
| 5,706,905 | A | 1/1998 | Barr | |
| 5,803,185 | A | 9/1998 | Barr et al. | |
| 5,816,344 | A | 10/1998 | Turner | |
| 5,833,541 | A | 11/1998 | Turner et al. | |
| 5,842,149 | A | 11/1998 | Harrell et al. | |
| 5,927,409 | A | 7/1999 | Turner | |
| 5,931,000 | A | 8/1999 | Turner et al. | |
| 6,019,201 | A | 2/2000 | Gordaminejad et al. | |
| 6,102,681 | A | 8/2000 | Turner | |
| 6,105,690 | A | 8/2000 | Biglin, Jr. et al. | |
| 6,116,354 | A | 9/2000 | Buytaert | |
| 6,123,312 | A | 9/2000 | Dai | |
| 6,123,561 | A | 9/2000 | Turner et al. | |
| 6,134,892 | A | 10/2000 | Turner et al. | |
| 6,158,529 | A | 12/2000 | Dorel | |
| 6,257,356 | B1 | 7/2001 | Wassell | |
| 6,378,558 | B1 | 4/2002 | Pohl et al. | |
| 6,543,589 | B2 | 4/2003 | Anderson | |
| 6,568,470 | B2 | 5/2003 | Goodson, Jr. et al. | |
| 6,895,798 | B2 | 5/2005 | Sosnowski | |
| 6,958,704 | B2 | 10/2005 | Vinegar et al. | |
| 7,021,406 | B2 | 4/2006 | Zitha | |
| 7,032,670 | B2 | 4/2006 | Zitha | |
| 7,036,612 | B1 | 5/2006 | Raymond et al. | |
| 7,219,752 | B2 | 5/2007 | Wassell et al. | |
| 7,287,604 | B2 | 10/2007 | Aronstam et al. | |
| 7,891,430 | B2 | 2/2011 | Willauer | |
| 7,898,133 | B2 * | 3/2011 | Lieberman | H02N 15/00 310/90.5 |
| 7,931,098 | B2 | 4/2011 | Aronstam et al. | |
| 7,997,357 | B2 | 8/2011 | Wassell et al. | |
| 8,087,476 | B2 | 1/2012 | Wassell | |
| 2004/0246649 | A1 * | 12/2004 | Besen | H01F 7/081 361/170 |
| 2005/0056463 | A1 | 3/2005 | Aronstam et al. | |
| 2006/0219496 | A1 | 10/2006 | Dimig | |
| 2006/0226942 | A1 | 10/2006 | Dimig et al. | |
| 2008/0315471 | A1 | 12/2008 | Wassell et al. | |
| 2010/0224410 | A1 | 9/2010 | Wassell | |

FOREIGN PATENT DOCUMENTS

| | | | |
|---|---|---|---|
| EP | 0 841 462 | A2 | 5/1998 |
| EP | 2404076 | A1 | 1/2012 |
| GB | 2424018 | A | 9/2006 |
| WO | WO 9922383 | A1 | 5/1999 |
| WO | WO 2005047640 | A2 | 5/2005 |
| WO | WO 2010101902 | A1 | 9/2010 |

OTHER PUBLICATIONS

Chen, S.L., "Field Investigation of the Effects of Stick-Slip, Lateral and Whirl Vibrations on Roller Cone Bit Performance," SPE 56439, presented at the 58.sup.th SPE ATCE, Houston, Oct. 3-6, 1991.

DeAntonio, D.A. , "Soft Magnetic Ferritic Stainless Steels," Advanced Materials & Processes, Oct. 2003, 29-32.

Dykstra, M.W., "Experimental Evaluations of Drill Bit and Drill String Dynamics," SPE 28323, presented at the 61.sup.st SPE ATCE, New Orleans, Sep. 25-28, 1994.

Harvey, P., "The Design of Steerable Systems to Minimize the Adverse Effects of Motor Imbalance and Drillstring Forces," SPE 22565, presented at the 66.sup.th SPE ATCE, Dallas, Oct. 6-9, 1991.

Notification of Transmittal of the International Search Report and the Written Opinion of the International Searching Authority mailed Apr. 27, 2010, PCTUS2010025897.

Response to Written Opinion submitted Jul. 27, 2010 PCTUS2010025897 APS Technology.

Spencer Jr., B.F., "Phenomenological Model of a Magnetorheological Damper," Journal of Engineering Mechanics, ASCE, 123 230-238, 1997.

Tavares, S.S.M. et al., "Magnetic properties of an AISI 420 martensitic stainless steel," Journal of Alloys and Compounds, Nov. 16, 2000, 307-314.

Turner, W.E., "New Isolator for Controlling BHA Vibrations," Energy Week Conference, Houston, Jan. 27, 1997.

Warren, T.M., "Shock Sub Performance Tests," IADC/SPE 39323, presented at the 1998 IADC/SPE Drilling Conference, Dallas, Mar. 3-6, 1998.

Written Opinion of the International Preliminary Examining Authority mailed Apr. 4, 2011 PCTUS2010025897.

Written Opinion of the International Searching Authority mailed Apr. 27, 2010, PCTUS2010025897.

Zhu, J.G., "Numerical Modelling of Magnetic Materials for Computer Aided Design of Electromagnetic Devices," Eng. Sc., B.E. (Elec.) University of Technology, Sydney, Jul. 1994.

International Patent Application No. PCT/US2012/054207: International Search Report dated Dec. 10, 2012, 5 pages.

Chinese Application No. 201280043953.5: Office Action dated Dec. 18, 2015, 10 pages.

* cited by examiner

| I (amps) | F (1000's Gaus) | History Stack | |
|---|---|---|---|
| 3 | 50 | | |
| 0 | 0 | | |
| | | | |
| 4 | 60 | | |
| 3 | 50 | | |
| 0 | 0 | | |
| | | | |
| 3 | 50 | 4 | 60 |
| 4 | 60 | | |
| 3 | 50 | | |
| 0 | 0 | | |
| | | | |
| 1 | 20 | | |
| 3 | 50 | 4 | 60 |
| 4 | 60 | | |
| 3 | 50 | | |
| 0 | 0 | | |
| | | | |
| 2 | 30 | | |
| 1 | 20 | 1 | 20 |
| 3 | 50 | 4 | 60 |
| 4 | 60 | | |
| 3 | 50 | | |
| 0 | 0 | | |
| | | | |
| 5 | 80 | | |
| 2 | 30 | | |
| 1 | 20 | 1 | 20 |
| 3 | 50 | ~~4~~ | ~~60~~ |
| 4 | 60 | | |
| 3 | 50 | | |
| 0 | 0 | | |
| | | | |
| 3 | 50 | | |
| 5 | 80 | | |
| 2 | 30 | 5 | 80 |
| 1 | 20 | 1 | 20 |
| 3 | 50 | ~~4~~ | ~~60~~ |
| 4 | 60 | | |
| 3 | 50 | | |
| 0 | 0 | | |
| | | | |
| 0.5 | 10 | | |
| 3 | 50 | | |
| 5 | 80 | | |
| 2 | 30 | 5 | 80 |
| 1 | 20 | ~~1~~ | ~~20~~ |
| 3 | 50 | ~~4~~ | ~~60~~ |
| 4 | 60 | | |
| 3 | 50 | | |

Fig. 14

SYSTEM AND METHOD FOR DAMPING VIBRATION IN A DRILL STRING USING A MAGNETORHEOLOGICAL DAMPER

STATEMENT OF RELATED APPLICATIONS

This application is a continuation-in-part of U.S. application Ser. No. 12/398,983, now U.S. Pat. No. 8,087,476, entitled System and Method for Damping Vibration in a Drill String Using a Magnetorheological Damper, filed Mar. 5, 2009, the contents of which is hereby incorporated by reference in its entirety.

STATEMENT OF GOVERNMENT INTEREST

Pursuant to 35 U.S.C. § 202(c), it is acknowledged that the U.S. government may have certain rights to certain aspects of the invention described herein, which was made in part with funds from the Deep Trek program of the U.S. Department of Energy National Energy Technology Laboratory, Grant Number DE-FC26-02NT41664.

BACKGROUND OF THE INVENTION

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface to the bottom of the bore.

The drill bit is rotated so that the drill bit advances into the earth, thereby forming the bore. In rotary drilling, the drill bit is rotated by rotating the drill string at the surface. Piston-operated pumps on the surface pump high-pressure fluid, referred to as "drilling mud," through an internal passage in the drill string and out through the drill bit. The drilling mud lubricates the drill bit, and flushes cuttings from the path of the drill bit. In the case of motor drilling, the flowing mud also powers a drilling motor which turns the bit, whether or not the drill string is rotating. The drilling mud then flows to the surface through an annular passage formed between the drill string and the surface of the bore.

The drilling environment, and especially hard rock drilling, can induce substantial vibration and shock into the drill string. Vibration also can be introduced by factors such as rotation of the drill bit, the motors used to rotate the drill string, pumping drilling mud, imbalance in the drill string, etc. Such vibration can result in premature failure of the various components of the drill string. Substantial vibration also can reduce the rate of penetration of the drill bit into the drilling surface, and in extreme cases can cause a loss of contact between the drill bit and the drilling surface.

Operators usually attempt to control drill string vibration by varying one or both of the following: the rotational speed of the drill bit, and the down-hole force applied to the drill bit (commonly referred to as "weight-on-bit"). These actions are frequently in reducing the vibrations. Reducing the weight-on-bit or the rotary speed of the drill bit also usually reduces drilling efficiency. In particular, drill bits typically are designed for a predetermined range of rotary speed and weight-on-bit. Operating the drill bit away from its design point can reduce the performance and the service life of the drill bit.

So-called "shock subs" are sometimes used to dampen drill string vibrations. Shock subs, however, typically are optimized for one particular set of drilling conditions. Operating the shock sub outside of these conditions can render the shock sub ineffective, and in some cases can actually increase drill string vibrations. Moreover, shock subs and isolators usually isolate the portions of the drill string up-hole of the shock sub or isolator from vibration, but can increase vibration in the down-hole portion of the drill string, including the drill bit.

One approach that has been proposed is the use of a damper containing a magnetorheological (hereinafter "MR") fluid valve. The viscosity of MR fluid can be varied in a down-hole environment by energizing coils in the valve that create a magnetic field to which the MR fluid is subjected. Varying the viscosity of the MR fluid allows the damping characteristics to be optimized for the conditions encountered by the drill bit. Such an approach is disclosed in U.S. Pat. No. 7,219,752, entitled System And Method For Damping Vibration In A Drill String, issued May 22, 2007, hereby incorporated by reference in its entirety.

The aforementioned U.S. Pat. No. 7,219,752 discloses an MR valve using a mandrel to hold the coils that is made of 410 martensitic stainless steel. Prior art embodiments of similar MR valves have used coil holders made of 12L14 low carbon steel (which has a saturation magnetization of about 14,000 Gauss, a remanent magnetization of 9,000 to 10,000 Gauss, and a coercivity of about 2 to 8 Oersteds) and 410/420 martensitic stainless steel. The shafts in such embodiments have been made of 410 stainless steel, which can have a relative magnetic permeability of 750 Gauss and a coercivity of 6 to 36 Oe. Unfortunately, the inventors have found that the minimum level of damping achievable using such MR valves is compromised by the fact that energizing the coil can result in a low level of permanent magnetization of the valve components. Although this residual, or remanent, magnetization is considerably below that normally used to provide effective damping, it reduces the range of the MR fluid viscosity at the lower end and, therefore, the minimum damping that can be obtained. In prior art MR valves, the problem of remanent magnetization has been addressed by demagnetizing components of the valve that had become permanently magnetized by supplying to the coils current of alternating polarity and decreasing amplitude in a stepwise fashion.

A problem experienced by prior art MR valves is that using a coil to maintain the magnetic field requires a considerable amount of electrical energy. Consequently, turbine alternators, which are expensive and costly to maintain, are typically required to power the coils. An ongoing need, therefore, exists for a MR fluid damping system that can dampen drill-string vibrations, and particularly vibration of the drill bit, throughout a range of operating conditions, including high and low levels of damping, that does not require large amounts of electrical energy.

Moreover, in order to most efficiently operate the MR valve, it would be desirable to determine the current to be applied to the MR valve that is necessary to achieve the desired magnetic field, given the magnetization history of the MR valve. While technique have been proposed to model the magnetic field based on the history of the magnetization in Jian Guo Zhu's PhD thesis entitled "Numerical Modeling Of Magnetic Materials For Computer Aided Design Of Electromagnetic Devices," Chapter 2, "Modeling of Magnetic Hysteresis" (1994), such techniques have not been applied to the operation of MR valves. Further it would be desirable to increase the speed at which calculations of the magnetic field based on the magnetization history can be performed.

SUMMARY OF THE INVENTION

In one embodiment, the invention is applied to a damping system for damping vibration in a down hole portion of a drill string in which the damping system comprises an MR valve containing an MR fluid subjected to a magnetic field created by at least one coil. In this embodiment, the invention includes a method of operating the MR valve comprising the steps of: (a) energizing the coil of the MR valve for a first period of time so as to create a first magnetic field that alters the viscosity of the MR fluid, the first magnetic field being sufficient to induce a first remanent magnetization in at least one component of the MR valve, the first remanent magnetization being at least about 12,000 Gauss; (b) substantially de-energizing the coil for a second period of time so as to operate the MR valve using the first remanent magnetization in the at least one component of the MR valve to create a second magnetic field that alters the viscosity of the MR fluid; (c) subjecting the at least one component of the MR valve to a demagnetization cycle over a third period of time so as to reduce the first remanent magnetization of the at least one component of the MR valve to a second remanent magnetization; and (d) operating the MR valve for a third period of time after the demagnetization cycle in step (c). Preferably, the magnetic field associated with the first remanent magnetization is sufficient to magnetically saturate the MR fluid. The value of the remanent magnetization can be measured using a sensor and the coil re-energized when the value drops below a specified minimum.

In another embodiment, the invention is a method of damping vibration in a down hole portion of a drill string drilling into an earthen formation that comprises the steps of: (a) providing a magnetorheological (MR) valve having at least one coil and containing an MR fluid that flows through a passage formed in the MR valve, the MR valve having associated therewith a limiting hysteresis loop relating the strength of the magnetic field in the valve to the current supplied to the coil; (b) supplying a varying current to the coil so as to subject the MR fluid in the MR valve to a varying magnetic field created by the coil; (c) determining the magnetization history of the MR valve as the current supplied to the coil varies by measuring the varying current and calculating the strength of the magnetic field created by the varying current, the strength of the magnetic field determined using information representative of the limiting hysteresis loop associated with the MR valve; and (d) determining the current to be supplied to the coil that will result in a desired magnetic field using the magnetization history of the MR valve determined in step (c); and (e) supplying the current determined in step (d) to the coil so as to obtain the desired magnetic field. According to one aspect of this embodiment, the magnetization history of the MR valve comprises a first stack of first sets of data points, each the first sets of data points comprising a first data point that is representative of a current that was supplied to the coil and a second data point that is representative of the magnetic field that resulted from the supply of the current. In connection with this aspect, determining the current to be supplied to the coil in step (d) comprises the further steps of: (f) copying the first stack of first data points so as to create a second stack of data points; (g) adding one or more second sets of data points to the second stack of data points, each of the second sets of data points added to the second stack comprising a selected test current and the magnetization expected to result if the test current were supplied to the coil; and (h) performing a binary search of the data points in the second stack after the one or more second sets of data points have been added to the second stack so as to determine the current to be supplied to the coil that will result in the desired magnetic field. In a preferred version of this embodiment, the current that was supplied to the coil of which each of the first data points is representative is the current at which the change in current supplied to the coil reversed direction.

In another embodiment, the invention concerns a MR valve assembly for damping vibration of a drill bit for drilling into an earthen formation that comprises: (a) at least one coil and an MR fluid that flows through a passage formed in the MR valve proximate the coil; (b) memory means in which is stored information representative of the limiting hysteresis loop relating the strength of the magnetic field in the MR valve to the current supplied to the coil; (c) current control means for controlling the current supplied to the coil so as to vary the current and subject the MR fluid in the MR valve to a varying magnetic field created by the coil; and (d) history determining means for determining the magnetization history of the MR valve as the current supplied to the coil varies by measuring the varying current and calculating the strength of the magnetic field created by the varying current, the strength of the magnetic field determined using the information representative of the limiting hysteresis loop stored in the memory means; (e) current determining means for determining the current to be supplied to the coil that will result in a desired magnetic field using the magnetization history of the MR valve.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show embodiments that are presently preferred. The invention is not limited, however, to the specific instrumentalities disclosed in the drawings. In the drawings the Z arrow indicates the downhole direction or the bore hole, which may or may not be vertical, i.e., perpendicular to the Earth's surface.

FIG. 8(*b*) is a graph of the strength B of the magnetic field to which the MR fluid is subjected versus time, T, that results from energizing the coils according to FIG. 8(*a*).

FIG. 14 shows an example the progression of a history stack according to one method of operating an MR valve according to the current invention.

DESCRIPTION OF PREFERRED EMBODIMENTS

Figure 1:
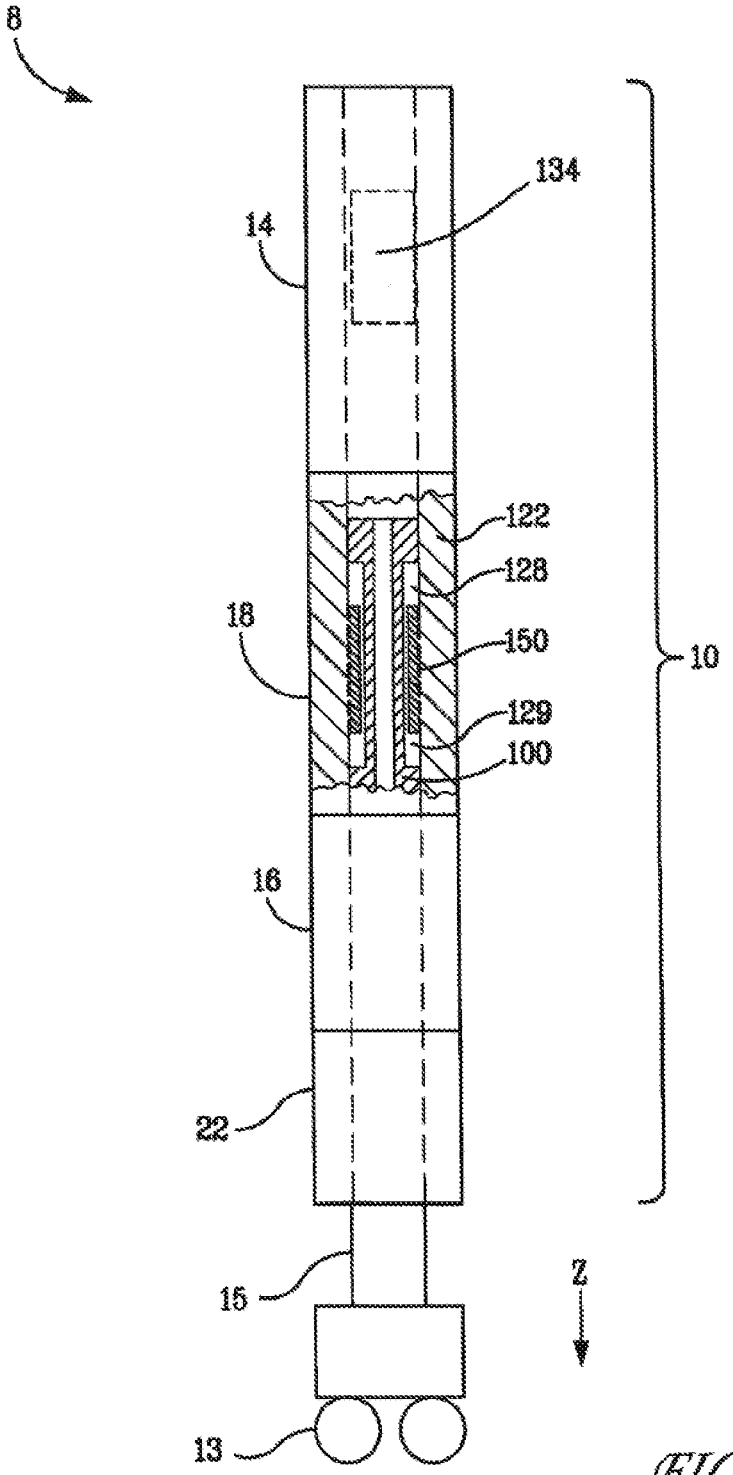
FIG. 1 is a longitudinal view of an embodiment of a vibration damping system installed as part of a drill string.
Figure 2:
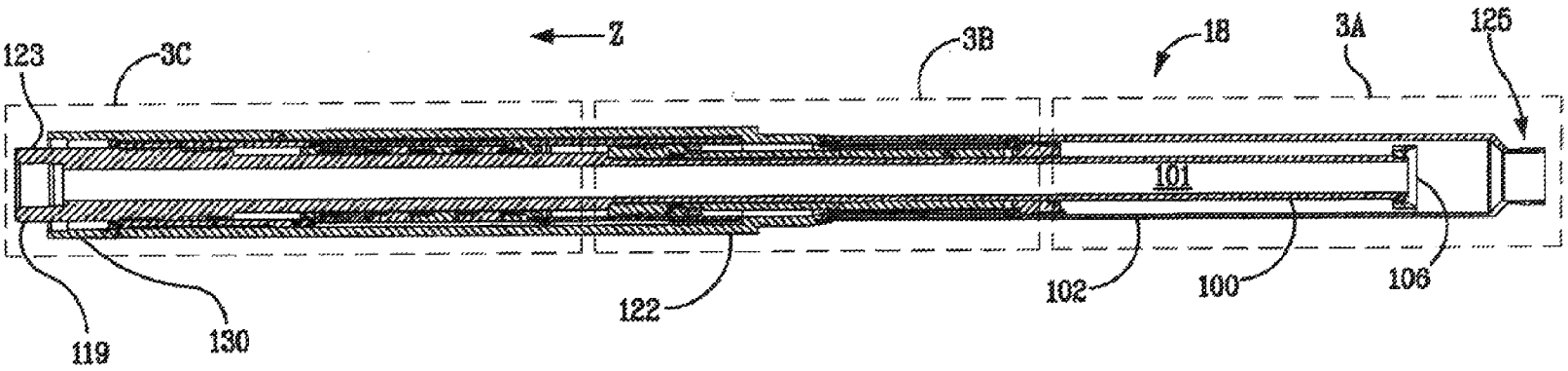
FIG. 2 is a longitudinal cross-sectional view of a valve assembly of the vibration damping system shown in FIG. 1.

The figures depict a preferred embodiment of a vibration damping system 10. As shown in FIG. 1, the vibration damping system 10 can be incorporated into a downhole portion of a drill string 8 to dampen vibration of a drill bit 13 located at a down-hole end of the drill string.

The downhole portion of the drill string 8 includes a power module 14. The vibration damping system 10 comprises a torsional bearing assembly 22 and a spring assembly 16, each of which is discussed more fully in the aforementioned U.S. Pat. No. 7,219,752. In addition, located between the spring assembly 16 and the power module 14 is a magnetorheological ("MR") valve assembly 18. The MR valve assembly 18 and the spring assembly 16 can produce axial forces that dampen vibration of the drill bit 13. The magnitude of the damping force can be varied by the MR valve assembly 18 in response to the magnitude and frequency of the drill bit vibration after the drill bit has temporarily ceased operation, for example during the incorporation of an additional section of drill pipe. In another embodiment, the magnitude of the damping force can be varied by the MR valve assembly 18 in response to the magnitude and frequency of the drill bit vibration on an automatic and substantially instantaneous basis while the drill bit is in operation.

The vibration damping assembly 10 is mechanically coupled to the drill bit 13 by a mandrel 15 that runs through the torsional bearing assembly 22 and spring assembly 16. Power module 14 provides power to the MR valve assembly 18 and may also provide power to other components of the drill string, such as an MWD system. In one embodiment, the power module 14 is a turbine alternator as discussed more fully in the aforementioned U.S. Pat. No. 7,219,752. In another embodiment, the power module 14 contains a battery pack. The controller 134 for the MR valve assembly may also be housed in the power module 14.

Preferably, the MR valve assembly 18 is located immediately down-hole of the power module 14 and uphole of the spring assembly 16, as shown in FIG. 1. Alternatively, the torsional bearing assembly 22 and spring assembly 16 could be located up-hole, between the MR valve assembly 18 and power module 14.

The MR valve assembly 18 is shown in FIGS. 2 and 3A, 3B and 3C. The MR valve assembly 18 has a downhole end 123 and an uphole end 125 and comprises a coil mandrel 100 positioned within an MR valve casing 122. Although a one piece coil mandrel is shown in these figures, the coil mandrel can be constructed from several pieces to simplify manufacturing and minimize the use of materials having special magnetic properties where not required. A central passage 101 formed through the coil mandrel 100 allows drilling mud to flow through MR valve assembly 18. A mud flow diverter 106 is attached to the end of the coil mandrel 100. Alternatively, the diverter 106 could be dispensed with and the coil mandrel 100 extended to coupling 104 and sealed at the coupling. In such an embodiment, holes can be formed in the uphole housing 102 so as to allow the compensation system to compensate to the pressure in the annulus surrounding the drill string, rather than to the pressure in the central passage 101 through the drill string.

At the downhole end 123 of the MR valve assembly 18, the coil mandrel 100 is secured by a coupling 119 to the mandrel 15 that extends through the torsional bearing assembly 22 and spring assembly 16 so that the coil mandrel 100 rotates, and translates axially, with the drill bit 13.

An uphole housing 102 encloses the uphole end of the coil mandrel 100. A coupling 104 on the uphole end of the uphole housing 102 is connected to the outer casing of the power module 14 so that the drilling torque from the surface is transferred through power module 14 to the uphole housing 102. The uphole housing 102 transmits the drilling torque to the outer casing of the spring assembly 16 and torsional bearing 22 via the MR valve casing 122, which is connected at its up hole end to the downhole end of the up hole housing 102, and at its downhole end 130 to the other casing of the spring assembly 16. The uphole housing 102 therefore rotates, and translates axially, with the outer casing of the torsional bearing 22 and spring assembly 16.

Figure 3B:
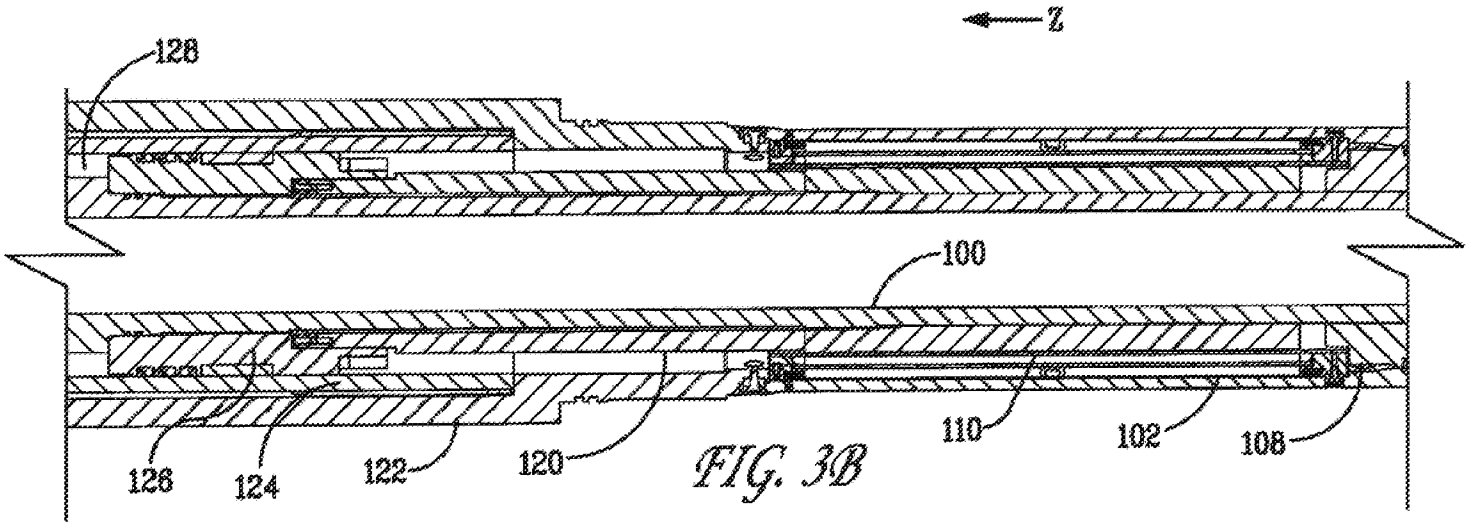
FIGS. 3A, 3B and 3C are detailed views of the portions of the valve assembly shown in FIG. 2.
Figure 3A:
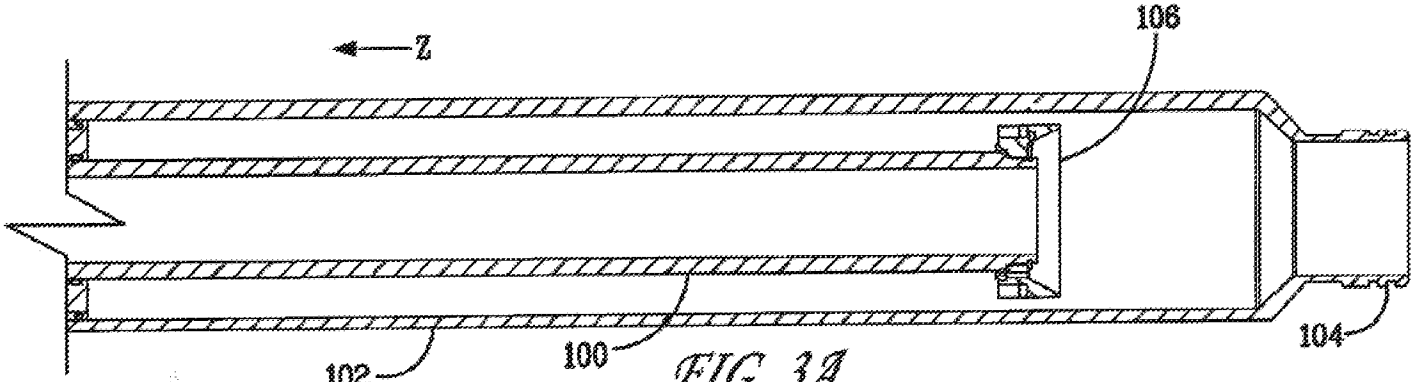

As shown in FIG. 3B, a linear variable displacement transducer (LVDT) 110 is located within the housing 102 between pistons 108 and 126 and spacer 120. The LVDT 110 senses the relative displacement between the uphole housing 102 and the coil mandrel 100 in the axial direction. The LVDT 110 preferably comprises an array of axially-spaced magnetic elements coupled to the housing 102 and a sensor, such as a Hall-effect sensor, mounted on the mandrel 100 so that the sensor is magnetically coupled to the magnetic elements. The LVDT 110, which is explained more fully in aforementioned U.S. Pat. No. 7,219,752, can provide an indication of the relative axial displacement, velocity, and acceleration of the housing 102 and the mandrel 100.

Figure 3C:
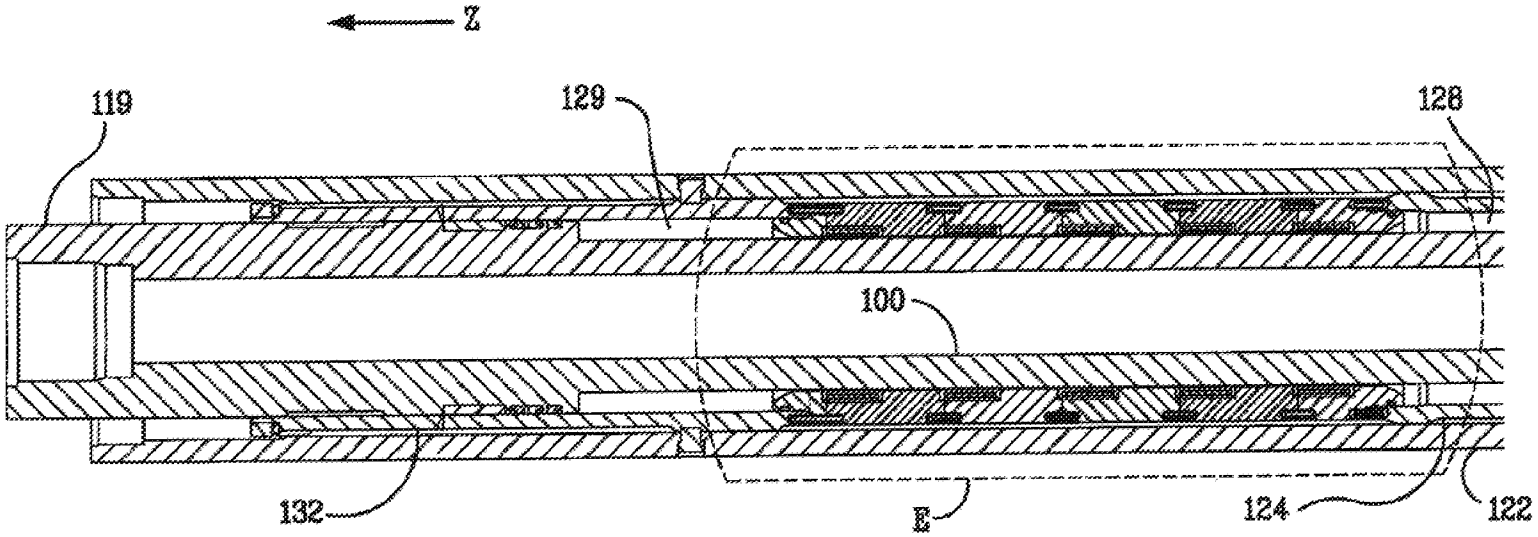

As shown in FIGS. 3B and C, an uphole valve cylinder 124 and a down hole valve cylinder 132 are fixedly mounted with the MR valve housing 122. As shown in FIG. 3C, a coil assembly is located between valve cylinder 124 and valve cylinder 132. An uphole MR fluid chamber 128 is formed between uphole valve cylinder 124 and the mandrel 100. A downhold MR fluid chamber 129 is formed between downhole valve cylinder 132 and the mandrel 100.

Figure 4A:
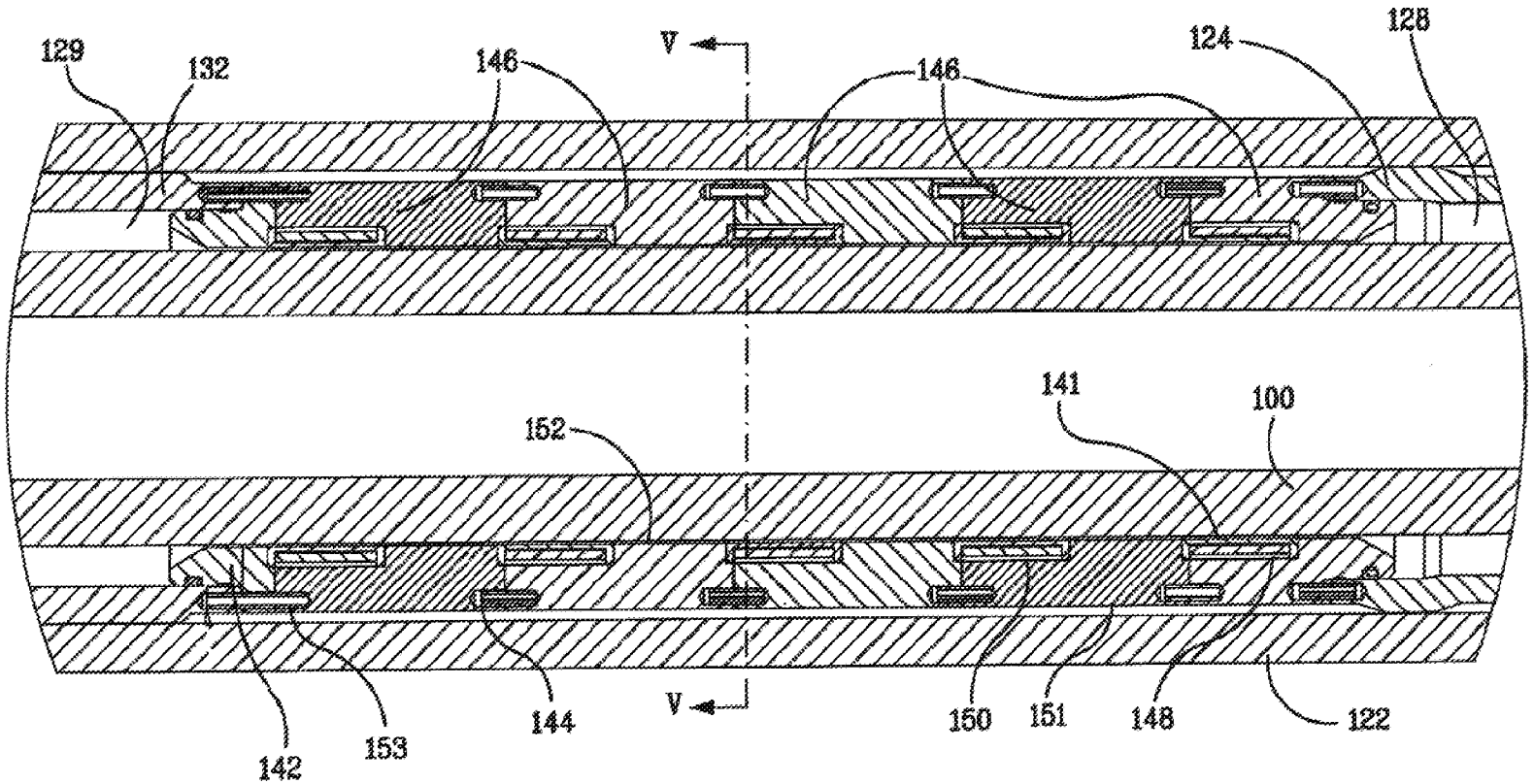
FIGS. 4A and 4B are detailed views of the portion of the valve assembly indicated by E in FIG. 3C, at two different circumferential locations.
Figure 4B:
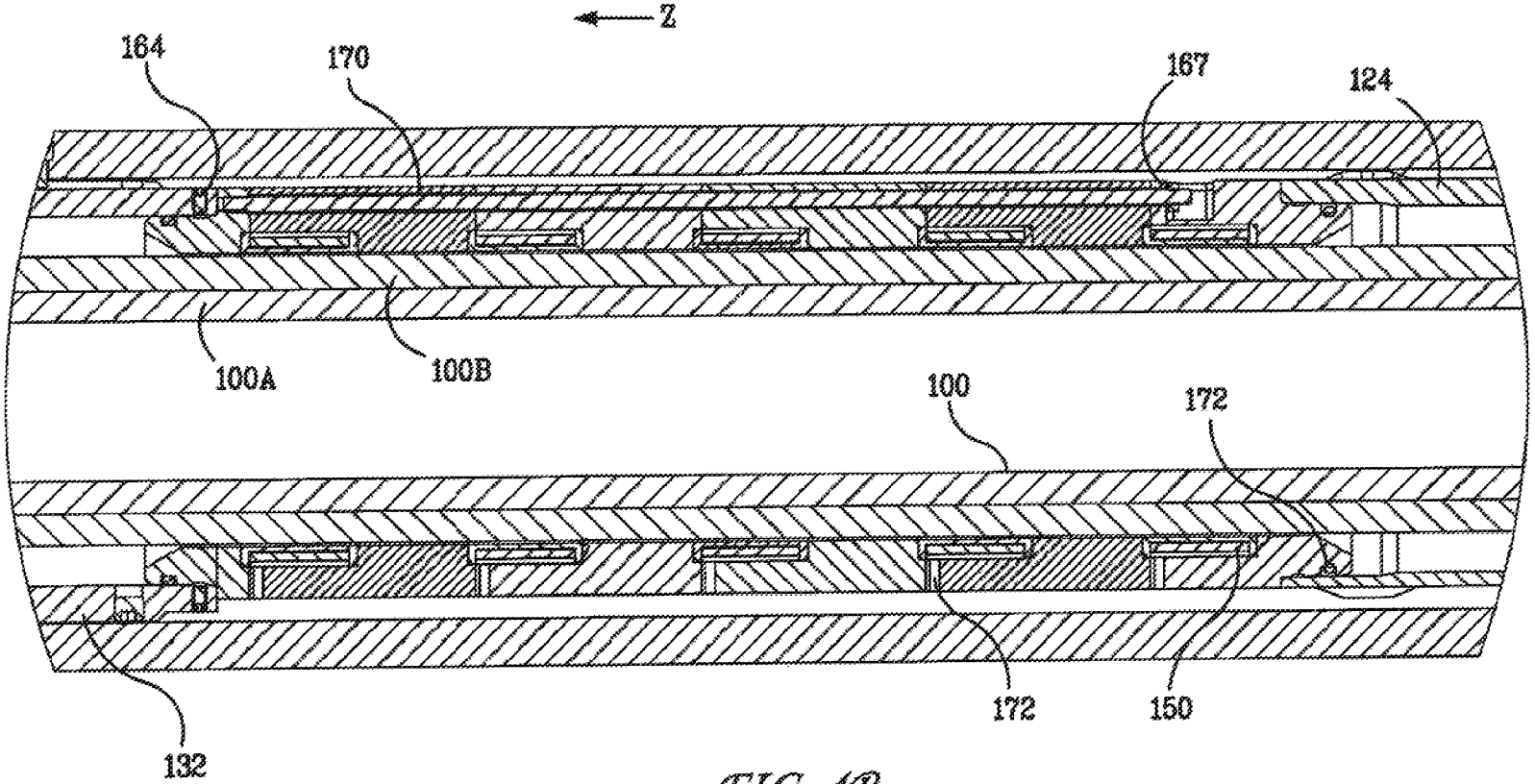
Figure 5:
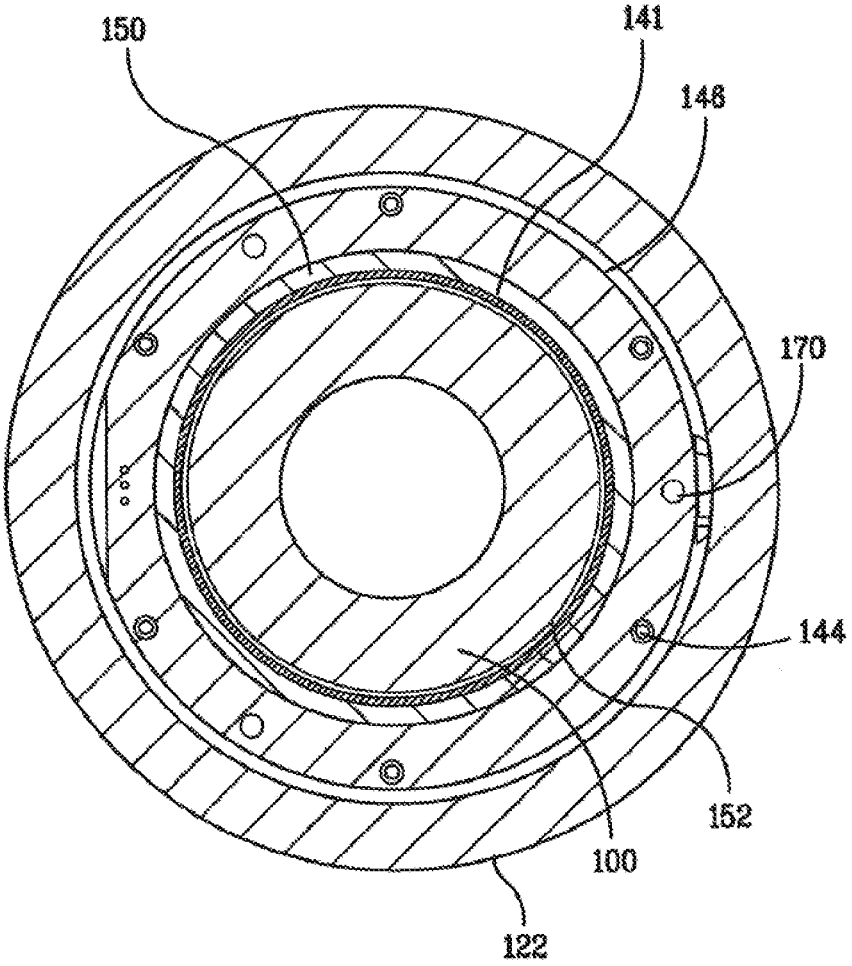
FIG. 5 is a transverse cross-section through the valve assembly along line V-V in FIG. 4A.

As shown in FIGS. 4A, 4B and 5, the coil assembly is comprised of a stack of coil holders 146 and an end cap 142 aligned via pins 144 and 153 to the valve cylinders 124, 132. Thus, the coil holders 146 and end cap 142 are maintained in a fixed relationship to the MR valve housing 122 so that the MR valve housing 122, valve cylinders 124 and 132, and coil holders 146 and end cap 142 form a functional unit relative to which the mandrel 100 reciprocates in response to vibration from the drill bit 13. The coil holders 146 and end cap 142 are held together by threaded rods 170, onto which nuts 164 and 167 are threaded. A slot 148 formed within each coil holder 146 holds a bobbin 141 around which a coil 150 is wrapped. A wire passage 172 formed in each coil holder 146 provides a passage for the coil wire. A circumferential gap 152, shown exaggerated in FIG. 4A, between the coil holders 146 and the mandrel 100 allows MR fluid to flow between the two chambers 128 and 129.

The first and second chambers 128, 129 are filled with a MR fluid. MR fluids typically comprise non-colloidal suspensions of ferromagnetic or paramagnetic particles. The particles typically have a diameter greater than approximately 0.1 microns. The particles are suspended in a carrier fluid, such as mineral oil, water, or silicon. Under normal conditions, MR fluids have the flow characteristics of a conventional oil. In the presence of a magnetic field, however, the particles suspended in the carrier fluid become polarized. This polarization cause the particles to become organized in chains within the carrier fluid. The particle chains increase the fluid shear strength (and therefore, the flow resistance or viscosity) of the MR fluid. Upon removal of the magnetic field, the particles return to an unorganized state, and the fluid shear strength and flow resistance returns to its previous value. Thus, the controlled application of a magnetic field allows the fluid shear strength and flow resistance of an MR fluid to be altered very rapidly. MR fluids are described in U.S. Pat. No. 5,382,373 (Carlson et al.), which is incorporated by reference herein in its entirety. An MR fluid suitable for use in the valve assembly 16 is available from the Lord Corporation of Indianapolis, Ind.

The coil mandrel 100 reciprocates within the MR valve housing 122 and valve cylinders 124, 132 in response to vibration of the drill bit 13. This movement alternately decreases and increases the respective volumes of the first and second chambers 128, 129. In particular, movement of the mandrel 100 in the up-hole direction (to the right in FIG. 4A) increases the volume of the first chamber 128, and decreases the volume of the second chamber 129. Conversely, movement of the mandrel 100 in the down-hole direction (to the left in FIG. 4A) decreases the volume of the first chamber 128, and increases the volume of the second chamber 129. The reciprocating movement of the coil mandrel 100 within the valve housing 122 thus tends to pump the MR fluid between the first and second chambers 128, 129 by way of the annular gap 152.

The flow resistance of the MR fluid causes the MR valve assembly 18 to act as a viscous damper. In particular, the flow resistance of the MR fluid causes the MR fluid to generate a force (opposite the direction of the displacement of the coil mandrel 100 in relation to the valve housing 122) that opposes the flow of the MR fluid between the first and second chambers 128, 129. The MR fluid thereby resists the reciprocating motion of the coil mandrel 100 in relation to the housing 122. This resistance can dampen axial vibration of the drill bit 13. Also, as discussed more fully in the aforementioned U.S. Pat. No. 7,219,752, the torsional bearing assembly 22 converts at least a portion of the torsional vibration of the drill bit 13 into axial vibration of the mandrel 100. Thus, the MR valve assembly 18 is also capable of damping torsional vibration of the drill bit 13.

The magnitude of the damping force generated by the MR fluid is proportional to the flow resistance of the MR fluid and the frequency of the axial vibration. The flow resistance of the MR fluids, as noted above, can be increased by subjecting the MR fluid to a magnetic field. Moreover, the flow resistance can be altered by varying the magnitude of the magnetic field.

The coils 150 are positioned so that the lines of magnetic flux generated by the coils cut through the MR fluid located in the first and second chambers 128, 129 and the gap 152. The current supplied to the coils 150, and thus the magnitude of the magnetic flux, preferably varies during drilling and is controlled by a controller 134, which may be located in the power module 14, as shown in FIG. 1. The controller 134 controls the current (power) supplied to the coils 150.

The LVDT 110 provides a signal in the form of an electrical signal indicative of the relative axial position, velocity, and acceleration between the uphole housing 102, and hence the MR valve housing 122, and the coil mandrel 100, which is connected to the drill bit 13. Hence, the output of the LVDT 110 is responsive to the magnitude and frequency of the axial vibration of the drill bit 13. In one embodiment, the LVDT 110 sends information concerning the vibration of the drill bit 13 to the surface for analysis. Based on this information, the drill rig operator can determine whether a change in the damping characteristics of the MR valve 18 is warranted during the next stoppage of the drill bit 13. If so, the operator will send a signal to the controller 134 during the stoppage instructing it to change the power supplied to the coils 150 and thereby alter the magnetic field to which the MR fluid is subjected and the dampening provided by the MR valve 10.

In another embodiment, the controller 134 preferably comprises a computing device, such as a programmable microprocessor with a printed circuit board. The controller 134 may also comprise a memory storage device, as well as solid state relays, and a set of computer-executable instructions. The memory storage device and the solid state relays are electrically coupled to the computing device, and the computer-executable instructions, including those for performing the method described in the flow charts in FIGS. 16-20, discussed below, are stored on the memory storage device.

The LVDT 110 is electrically connected to the controller 134. The computer executable instructions include algorithms that can automatically determine the optimal amount of damping at a particular operating condition, based on the output of the LVDT 100. The computer executable instructions also determine the desired magnetic field to be produced by the coils and/or the electrical current that needs to be directed to the coils 150 to provide the desired magnetic field, for example by employing the method described in the flow charts in FIGS. 16-20 discussed below. The controller 134 can process the input from the LVDT 110, and generate a responsive output in the form of an electrical current directed to the coils 150 on a substantially instantaneous basis. Hence, the MR valve assembly 18 can automatically vary the damping force in response to vibration of the drill bit 13 on a substantially instantaneous basis—that is, while the drill bit 13 is operating.

Preferably, the damping force prevents the drill bit 13 from losing contact with the drilling surface due to axial vibration. The controller 134 preferably causes the damping force to increase as the drill bit 13 moves upward, to help maintain contact between the drill bit 13 and the drilling surface. (Ideally, the damping force should be controlled so the weight-on-bit remains substantially constant.) Moreover, it is believed that the damping is optimized when the dynamic spring rate of the vibration damping system 10 is approximately equal to the static spring rate. (More damping is required when the dynamic spring rate is greater than the static spring rate, and vice versa.)

In any event, whether done during periodic stoppages of the drill bit 13 or automatically on an essentially instantaneous basis, the ability to control vibration of the drill bit 13, it is believed, can increase the rate of penetration of the drill bit, reduce separation of the drill bit 13 from the drilling surface, lower or substantially eliminate shock on the drill bit, and increase the service life of the drill bit 13 and other components of the drill string. Moreover, the valve assembly and the controller can provide optimal damping under variety of operating conditions, in contra-distinction to shock subs. Also, the use of MR fluids to provide the damping force makes the valve assembly 14 more compact than otherwise would be possible.

Operation of the MR valve 10 by energizing the coils 150 whenever an increase in damping is necessary beyond that provided by the MR fluid that is not subjected to a magnetic field requires a relatively large amount of electrical power since the dc current supplied to the coils may be in excess of 2 amps. At such power levels, battery packs typically used in downhole systems, such as for an MWD system, would only last about twelve hours. Therefore, operation in such a manner is typically done using a turbine alternator as the power module, as discussed in aforementioned U.S. Pat. No. 7,219,752.

According to the invention, the need for continuous electrical power is eliminated by fabricating portions of the MR valve—in one embodiment, the coil holders 146, shaft 100 and end cap 142—from a material that will, overtime, become somewhat essentially "permanently" magnetized to a substantial degree—that is, as a result of being subjected to the magnetic field of the coils 150, they will maintain their magnetism after the magnetic field has been removed. Thus, when the coils 150 are de-energized to a very low state, or turned off completely, the coil holders 146, shaft 100 and end cap 142 may retain a remanent degree of magnetization that will generate a magnetic field maintaining a relatively high viscosity of the MR fluid. Whether or not they become magnetized, portions of the valve that are not proximate the gap 152 through which the MR fluid flows will have little effect on the performance of the damper. The materials for these portions are chosen based on their structural, rather than magnetic properties.

According to the invention, the MR valve 10 is constructed so that some or all of the components of the valve are made from a material having sufficient residual magnetization so that the strength of the residual magnetic field generated by the components is still relatively high when the electrical field inducing the magnetic field, as a result of the dc current through the coils 150, is eliminated. In other words, according to one aspect of the invention, the residual magnetism phenomenon, which in prior art MR valves created a problem that required a demagnetization cycle to avoid, is intentionally enhanced. When, during initial operation of the MR valve 10, it is desired to increase the damping beyond that afforded by the MR fluid subjected to zero magnetic field, the batteries will supply a current of, for example, 2.5 amps, for a period of time preferably only sufficiently long to create the desired residual magnetization in the valve components, typically less than about 100 milliseconds. After this period of time, the coils 150 are energized to a lower value and the residual magnetic field of the MR valve components is primarily used to create the necessary damping thereafter. Preferably, the coils 150 are completely de-energized and the residual magnetic field of the MR valve components is solely used to create the necessary damping thereafter. According to one aspect of the invention, the materials from which the valve components are made, as discussed further below, are selected so that the remanent magnetic field is at least about 12,000 Gauss.

If, after a period of time operating at this level of damping, it were determined by the operator or the controller 134 that additional damping was required, the coils 150 would be energized at a higher current than that previously used, for a period of time sufficient to magnetically saturate the parts. This higher current will result in higher residual magnetism in the MR valve components that is then used to provide the additional damping after the coils 150 were again de-energized.

If, still later, it were determined by the operator or the controller 134 that less damping was required, the MR valve components would be subjected to a demagnetization cycle, discussed below, to reduce the residual magnetic field to approximately zero. If the new desired amount damping was less than that resulting from the residual magnetism of the MR valve, but greater than that afforded by the MR fluid at zero magnetic field, the coils 150 would then be temporarily energized as they were during the initial operation to create the desired degree of residual magnetization in the valve components. The coils 150 would then be partially or completely de-energized and the MR valve operated primarily or solely using the residual magnetism of the valve components.

According to one embodiment of the current invention, when desired, this permanent magnetization is removed by periodically using the coils 150 to subject the coil holders 146, shaft 100 and end cap 142, as well as any other MR valve components subject to being permanently magnetized, to a demagnetization cycle. According to one embodiment, the controller 134 includes circuitry, shown in FIG. 6, that was previously used in prior art MR valves to eliminate unwanted permanent magnetization. This circuitry, through which the dc electrical current from the power module 14 passes, converts the dc current into current of alternating polarity and decreasing amplitude in a stepwise fashion. During magnetization, or when the remanent magnetic field is to be left undisturbed, the current flows only in one direction, whereas when demagnetization is desired, reversing polarity is obtained.

Figures 6, 6A:
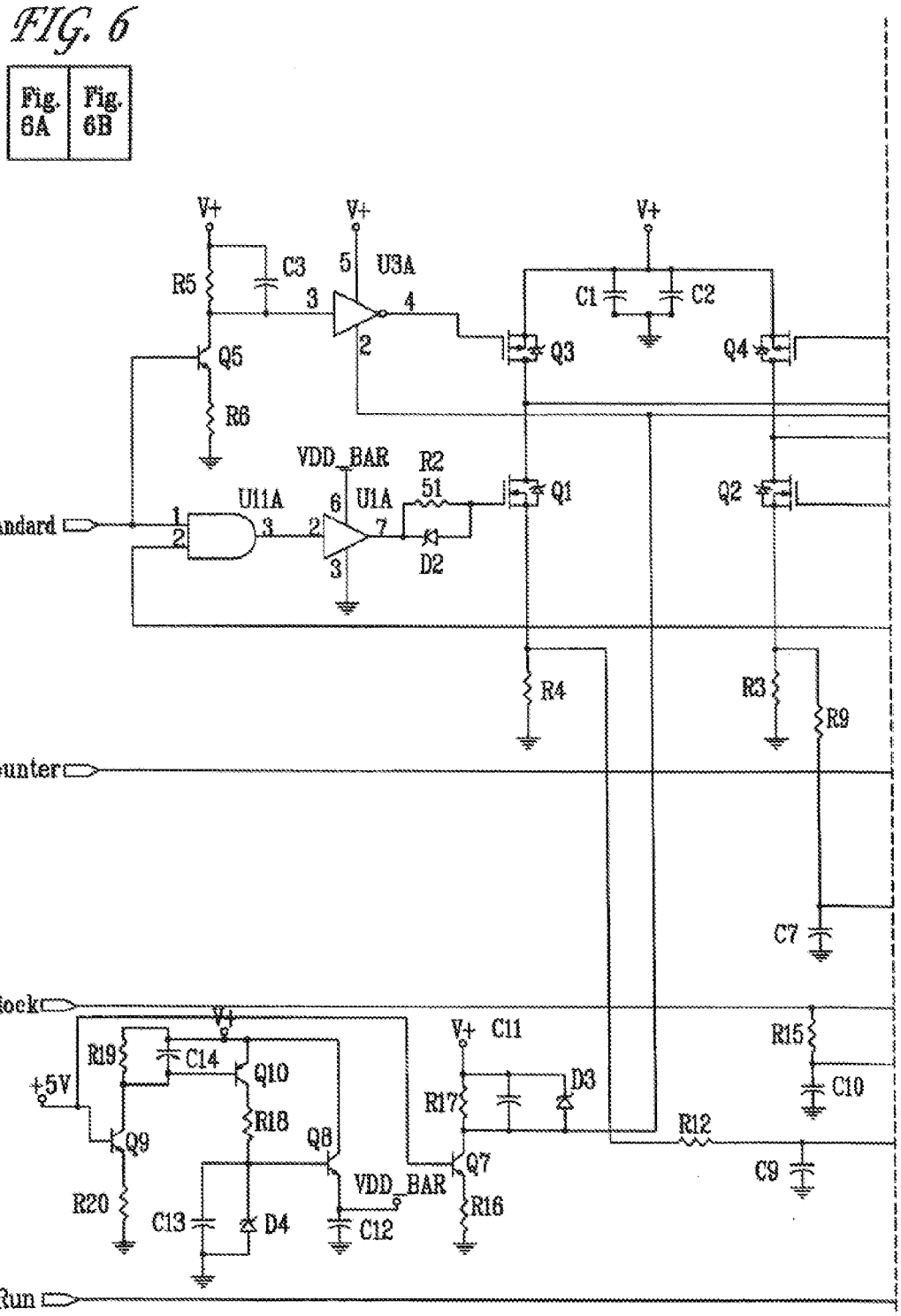
FIGS. 6A and 6B are schematic diagrams of a preferred embodiment of the circuitry for controlling power to the coils.
Figure 6B:
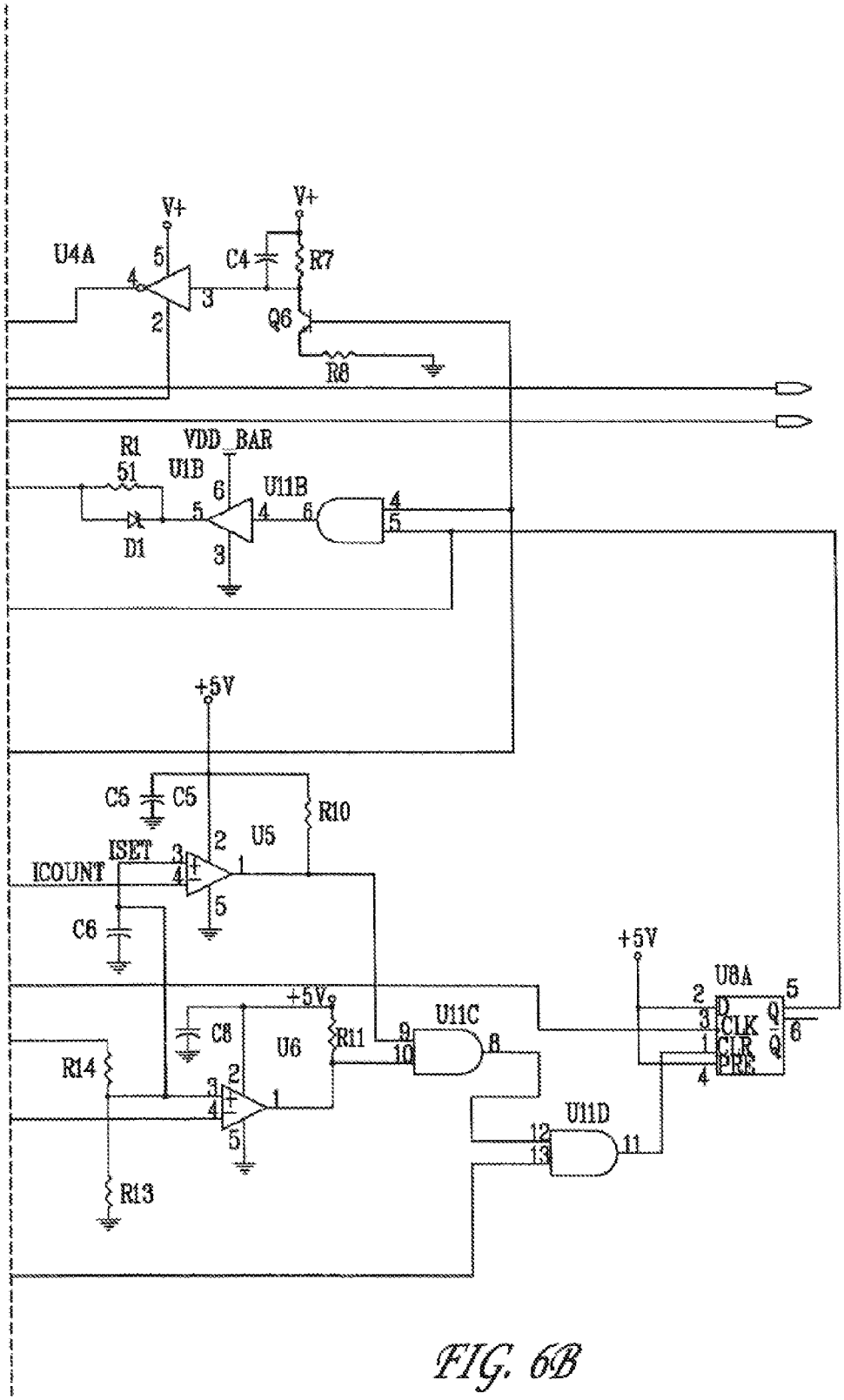
Figure 6C:
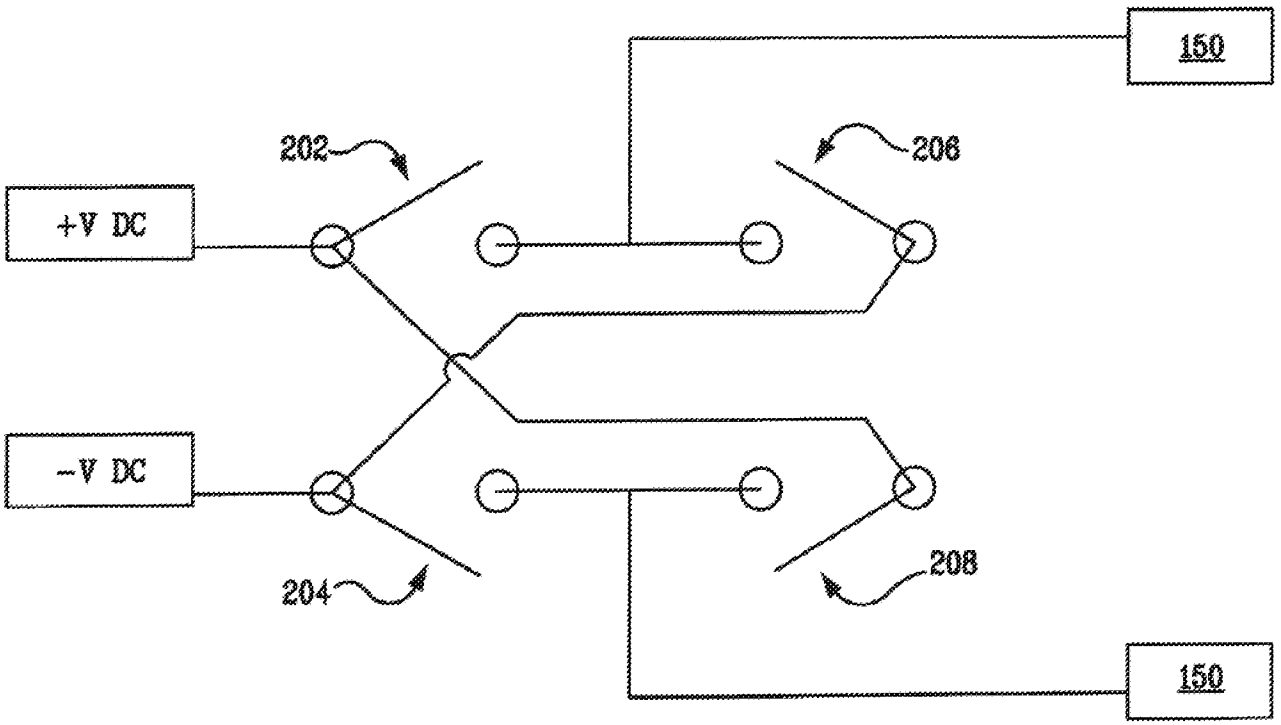
FIG. 6C is a simplified schematic diagram of circuitry for controlling power to the coils.

As shown in FIG. 6C, which is a simplified diagram of the circuitry shown in FIGS. 6A and B, the switches 202 and 204 work as a pair and switches 206 and 208 work as a pair. When 202 and 204 are switched, the upper coil 150 in FIG. 6C receives a positive voltage and the lower coil 150 receives a negative voltage. When switches 206 and 208 are energized, the coil polarity is reversed so the upper coil 150 receives a negative voltage and the lower coil 150 receives a positive voltage. In this way, reversing polarity is obtained. The software switches the pairs in a break-before-make sequence to ensure that the switch does not just short out because having both pairs of switches on at the same time would connect the plus and minus supplies through the switch with enough current draw to possibly do damage.

To control the voltage in a stepwise fashion a process known as Pulse Width Modulation is used (PWM). To accomplish this, the switch pairs are switched on and off very fast, typically operating at several hundred to several thousand hertz. The percentage of on-time versus off-time essentially scales the voltage by that percentile. For example, if the supply voltage is 40 VDC and the duty cycle is 50% the effective voltage on the coil is 20 VDC. The electronics and the coil inductance filter the modulated signal and smooth out the pulses to a steady DC at a lower value than the supply. This allows the gradually scaling down of the supply voltage from full-on (i.e., 100% duty cycle, switches always on) to near zero (i.e., 5% duty cycle, switch on for a very short time but off for the majority of the time).

Figure 7:
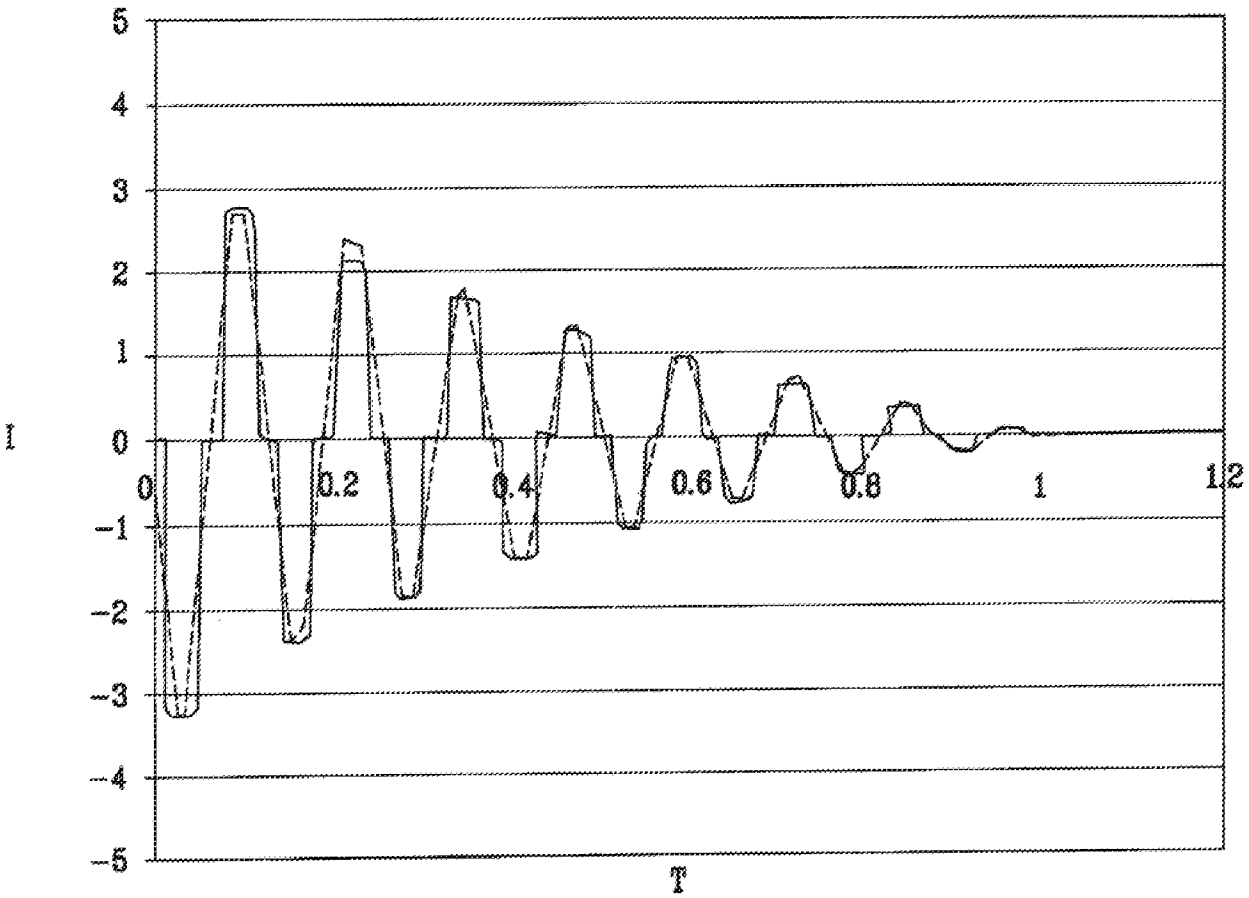
FIG. 7 is a graph of current, I, in amps, supplied to the coils versus time, T, in seconds, for a demagnetization cycle according to the current invention.

A typical prior art demagnetization cycle is shown in FIG. 7. After the coils are energized for period of time, an undesirable degree of residual magnetization may persist in the coil holders 146 and the end cap 142. Consequently, the coils 150 are energized according to the cycle shown in FIG. 7 in which the dc current reverses polarity and decreases in a stepwise fashion until it reaches a low current before diminishing to zero. Preferably, the demagnetization cycle is capable of reducing the remanent magnetic field to approximately zero.

In one typical embodiment, the duration of each step in the demagnetization cycle is about 0.06 second and the time between initiations of each step is about 0.1 second so that there is a slight "rest" period between each polarity reversal. The total number of steps is typically about sixteen so that the total time required for the demagnetization cycle is less than about two seconds. However, as will be apparent to those skilled in the art, other demagnetization cycles could also be utilized, provided the number and length of the steps is sufficient to reduce the remanent field to a low value, preferably, essentially zero. After demagnetization, completely de-energizing the coils will result in obtaining the minimum damping associated with non-magnetized MR fluid.

Although the use of current of alternating polarity and decreasing amplitude in a stepwise fashion in order to demagnetize the valve components is described above, other demagnetization methodologies could also be utilized, as discussed further below.

Figure 8A:
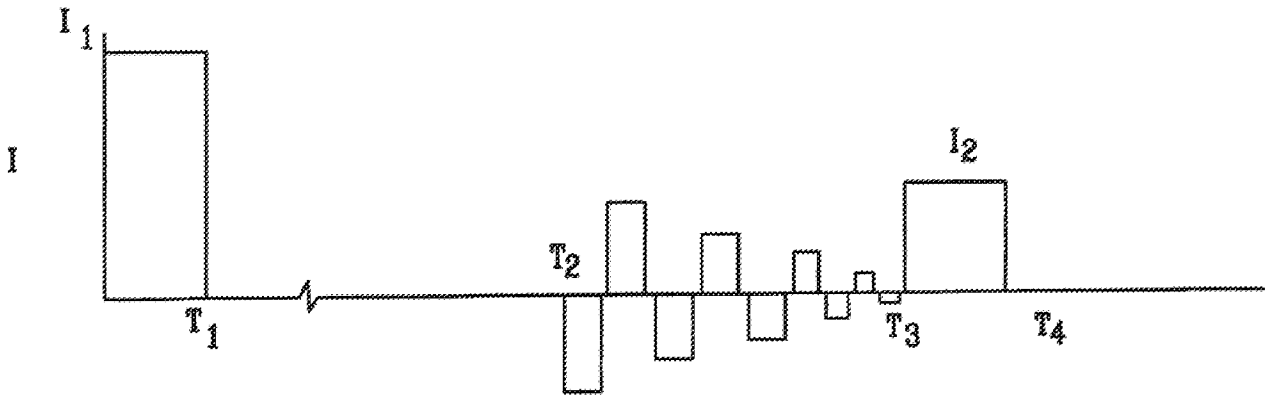
FIG. 8(*a*) is a graph of current, I, supplied to the coils versus time, T, in an operating mode that includes a demagnetization cycle and the use of remanent magnetization to create damping.
Figure 8B:
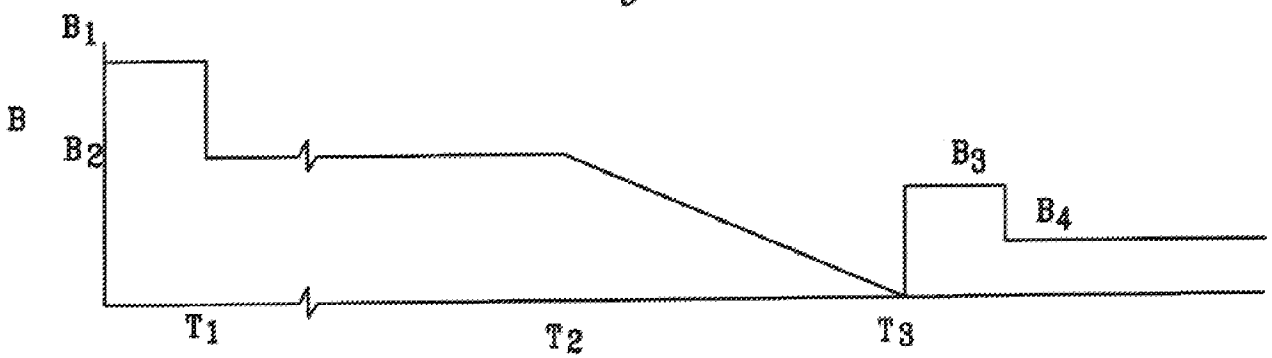

Operation of the MR valve 18 according to the invention is illustrated in FIGS. 8(*a*) and (*b*). Initially, it is determined that in order to obtain the desired degree of damping, the strength of the magnetic field to which the MR fluid is subjected should be $B_2$. However, the coils are initially energized to current $I_1$ so as to generate a higher magnetic field having strength $B_1$ for a period of time $T_1$ sufficient to induce a remanent magnetic field of strength $B_2$ in one or more components of the MR valve. Magnetic field having strength $B_1$ may, for example, be sufficient to induce saturation magnetization in the components of the MR valve so as to obtain the maximum subsequent remanent magnetic field. After time $T_1$, the coils are de-energized and the MR valve operated on the remanent magnetic field $B_2$ supplied by the components of the MR valve. The current invention allows the remanent magnetic field $B_2$ to be substantially greater than that obtainable when using prior art MR valves made with components of 12L14 low carbon steel and 410/420 martensitic stainless steel, which can obtain only relatively low remanent magnetization.

If, at time $T_2$ it is determined that less damping is required, a demagnetization cycle is initiated. At the completion of the demagnetization at time $T_3$, the coils are energized to current $I_2$ so as to generate a magnetic field having strength $B_3$ for a period of time sufficient to induce a remanent magnetic field of strength $B_4$ in one or more components of the MR valve. Thereafter, the coils are de-energized at time $T_4$ and the MR valve operated using the remanent magnetic field of strength $B_4$ from the components of the MR valve. Significantly, no electrical power is supplied to the coils 150 between $T_1$ and $T_2$ and subsequent to $T_4$.

Alternatively, the demagnetization cycle shown in FIG. 8 could be adjusted—for example, the number of steps and the current used in the final step, so as reduce the remanent magnetic field directly to the desired value without going down to zero remanent magnetization and then back up to the desired state. After the partial demagnetization cycle, the coils would be de-energized and the MR valve operated using its residual magnetism. Operation in this manner is illustrated in FIGS. 9(*a*) and (*b*).

Figure 9A:
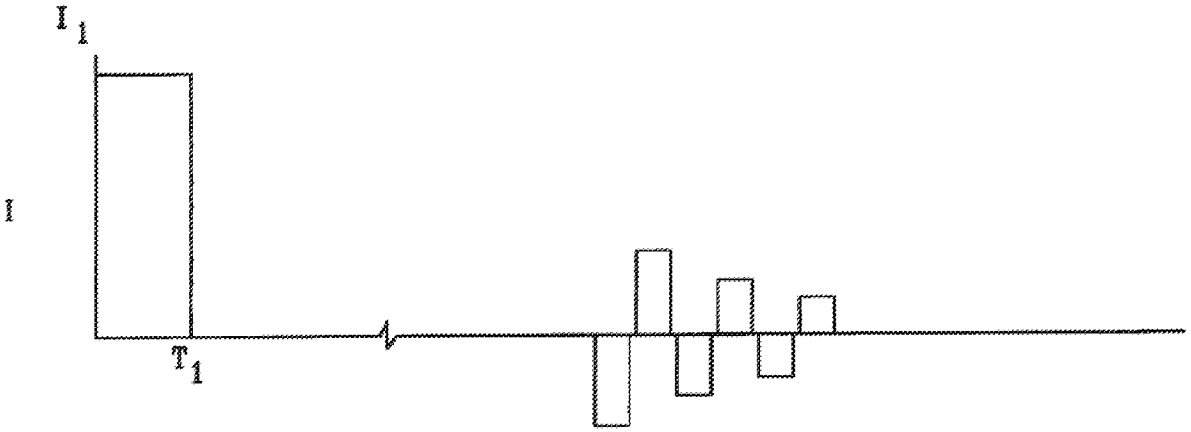
FIGS. 9(*a*) and (*b*) illustrate operation similar to FIGS. 8(*a*) and (*b*) but with a partial demagnetization cycle.
Figure 9B:
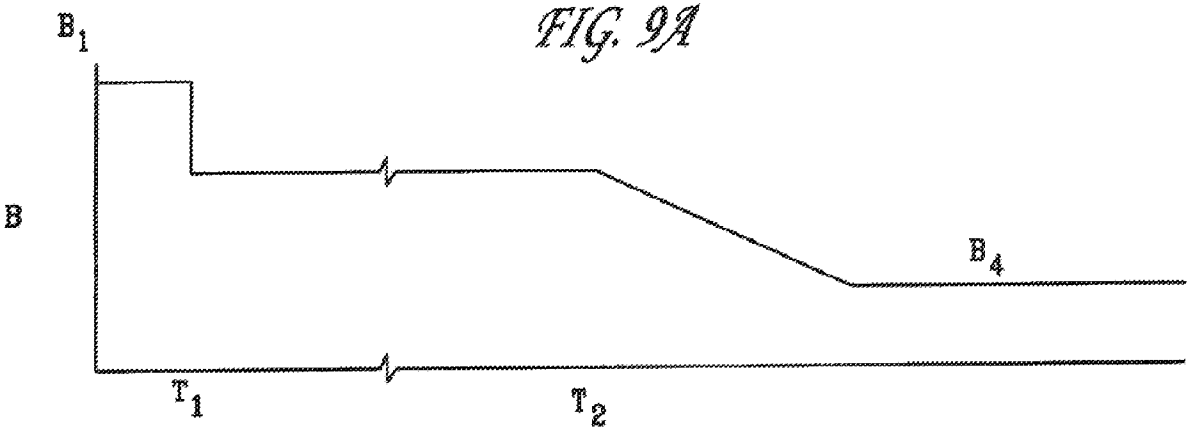

In the embodiment operated as illustrated in FIGS. 8 and 9, the MR valve is operated largely on residual magnetism, with power preferably being supplied to the coils 150 only as necessary to increase or decrease the amount of damping resulting from remanent magnetization of the MR valve components. As a result, the power supply module 14 can consist of a conventional downhole battery pack, without the need to incorporate a turbine alternator. Preferably, the battery pack comprises a number of high-temperature lithium batteries of a type well known to those skilled in the art. Thus, the use of the demagnetization cycle according to the current invention allows one to use an MR valve subject residual magnetization greater than that which created problems in prior art MR valves and to do so in such a way as to gain the unexpected benefit of reduced power consumption.

According to one embodiment of the invention, a feedback loop is incorporated to monitor the strength of the magnetic field in order to determine when the strength of the magnetic field drops below a value specified by the drill rig operator, or determined by the controller 134 if the MR valve is under the automatic control, thereby indicating the need to reenergize the coils 150. A circuit for measuring the strength of the magnetic field in the valve using one or more Hall effect sensors 304, such as Honeywell SS495A, located on the MR valve is shown in FIG. 10.

Figure 10:
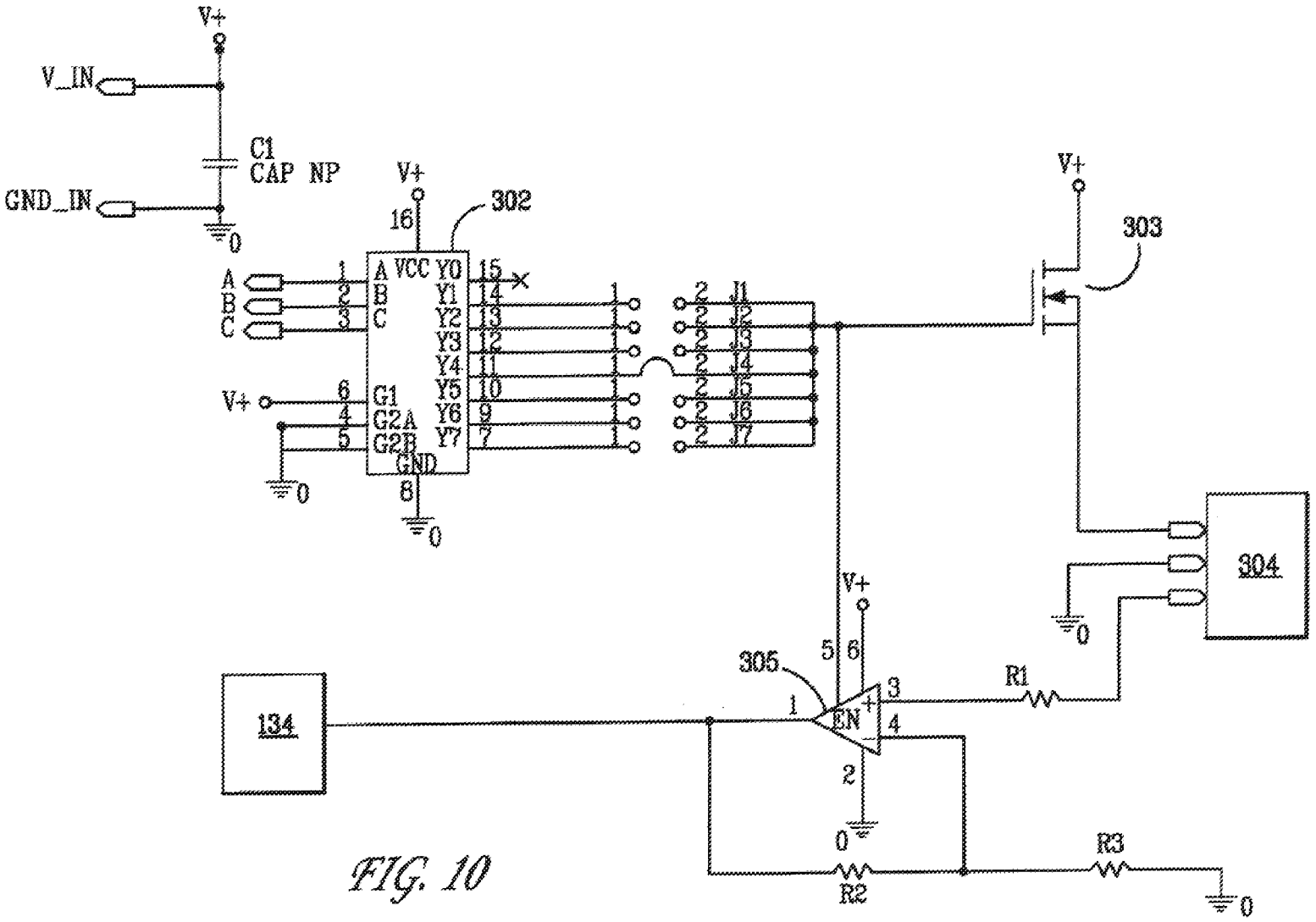
FIG. 10 is schematic diagram of a feedback loop for controlling the power to the coils.

As shown in FIG. 10, the circuit has five inputs and one output, two of the inputs are power and ground, the other three are digital address signals that allows multiple circuits to be distributed within the tool and individually turned on and measured remotely. In this embodiment, up to seven of these circuits can be distributed within the MR valve each with its own address as defined by the jumper settings (J 1 through 7 on the schematic in FIG. 10). A demultiplexor circuit 302, such as Texas Instruments CD74AC238, is used to take a signal from the three input lines (A, B, and C) and turn on the specific jumper that corresponds with that combination of high and low values on A, B, and C (for example A=high, B=low, C=low turns on jumper J1; A, B, C all high would turn on J7). The signal from the demultiplexor 302 (i) turns on a field effect transistor 303, such as BSS138/SOT, which provides power to the Hall effect sensor 304, and (ii) enables the operational amplifier 305, such as OPA373AIDBV.

The signal from the Hall effect sensor 304 is fed into the operational amplifier 305, which acts as a buffer with unity gain (R1=1K Ohm, R2=0 Ohm, and R3=infinite resistance). Alternatively, R2 and R3 could be used to boost the voltage by changing the resistance values but would not generally be required due to the stable output of the Hall effect sensor 304. The operational amplifier 305 allows the outputs from all seven circuits to be tied together so only a single signal goes back to the controller 134, thus saving valuable pins in the connector structure of the tool and utilizing only one of the few available A/D inputs to the microprocessor.

The purpose of the demultiplexor 302 is first to minimize the number of pins and Analog to digital (A/D) inputs required to feed back to the microprocessor (three digital outputs and one analog input, as opposed to five A/D inputs to look at individual hall effect sensors), and also to minimize the power draw. The power draw for Hall effect sensors 304 may be relatively very high—in one embodiment, 7 to 8 mAmps each. The maximum power draw for the demultiplexor 302 in this embodiment is 160 uAmps. As a result, there is a power savings of 4,400%, which allows the battery powering the circuit to last forty four times longer. The five distributed circuits in total draw 1/10 the power of a single Hall effect sensor. Thus the Hall effect sensors are only powered up briefly and only when the microprocessor is making a reading, also only one Hall effect sensor is on at a time so the power draw is minimized.

In operation, the controller 134 is programmed to poll the Hall effect sensors 304 one at a time, get an average value representative of the strength of the magnetic field in the MR valve, and compare it to the value specified by the operator or controller 134. The controller 134 is programmed to reenergize the coils 150 so as to re-magnetize the valve if this comparison indicates that the strength of the measured magnetic field deviates from the specified value by more than a predetermined amount. The controller 134 is programmed to perform this polling approximately every minute or so, unless the information received from the LVDT dictated a change in strength of the magnetic field, in which case the Hall effect sensors would be polled again after the magnetic field has been readjusted to determine if the magnetization was at the proper power.

Figure 11:
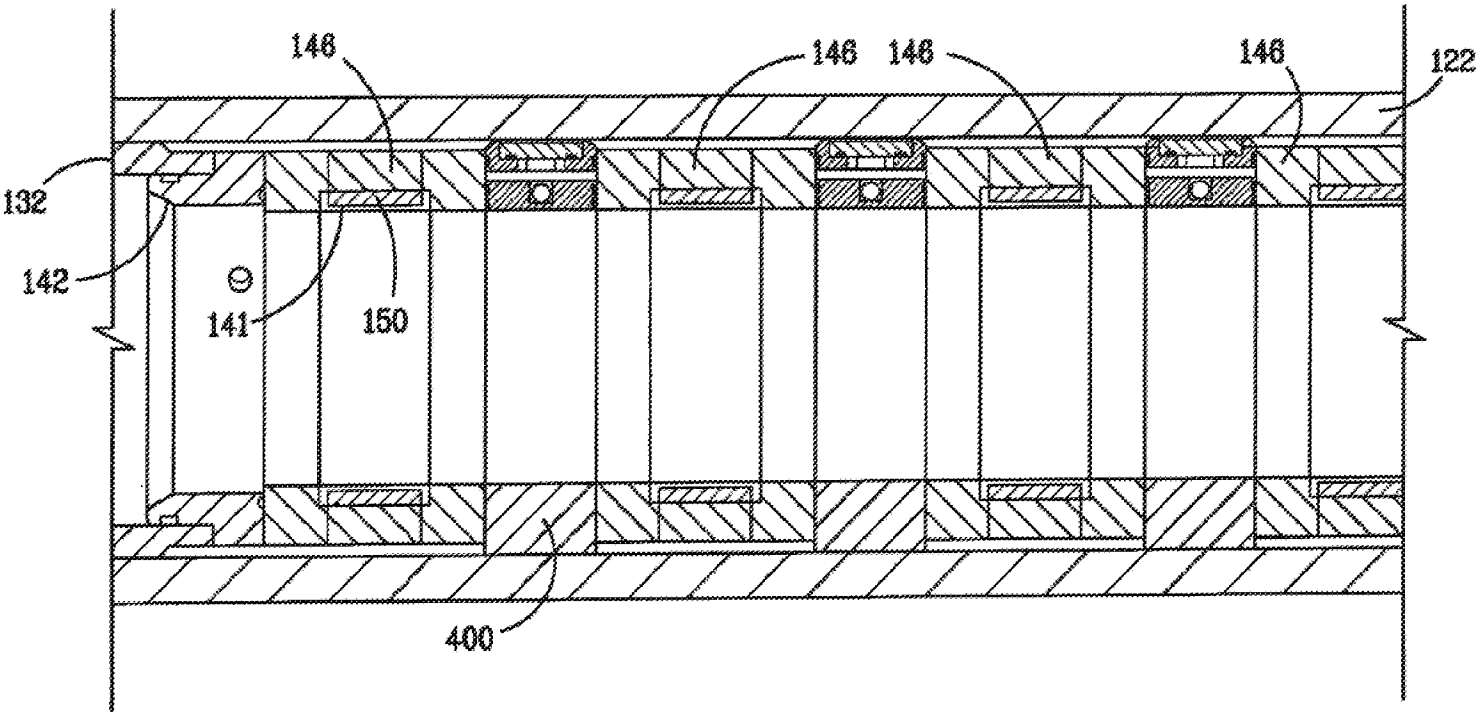
FIG. 11 is a longitudinal cross-section similar to that shown in FIG. 4C showing an alternate embodiment of the invention incorporating the feedback loop shown in FIG. 10.
Figure 12:
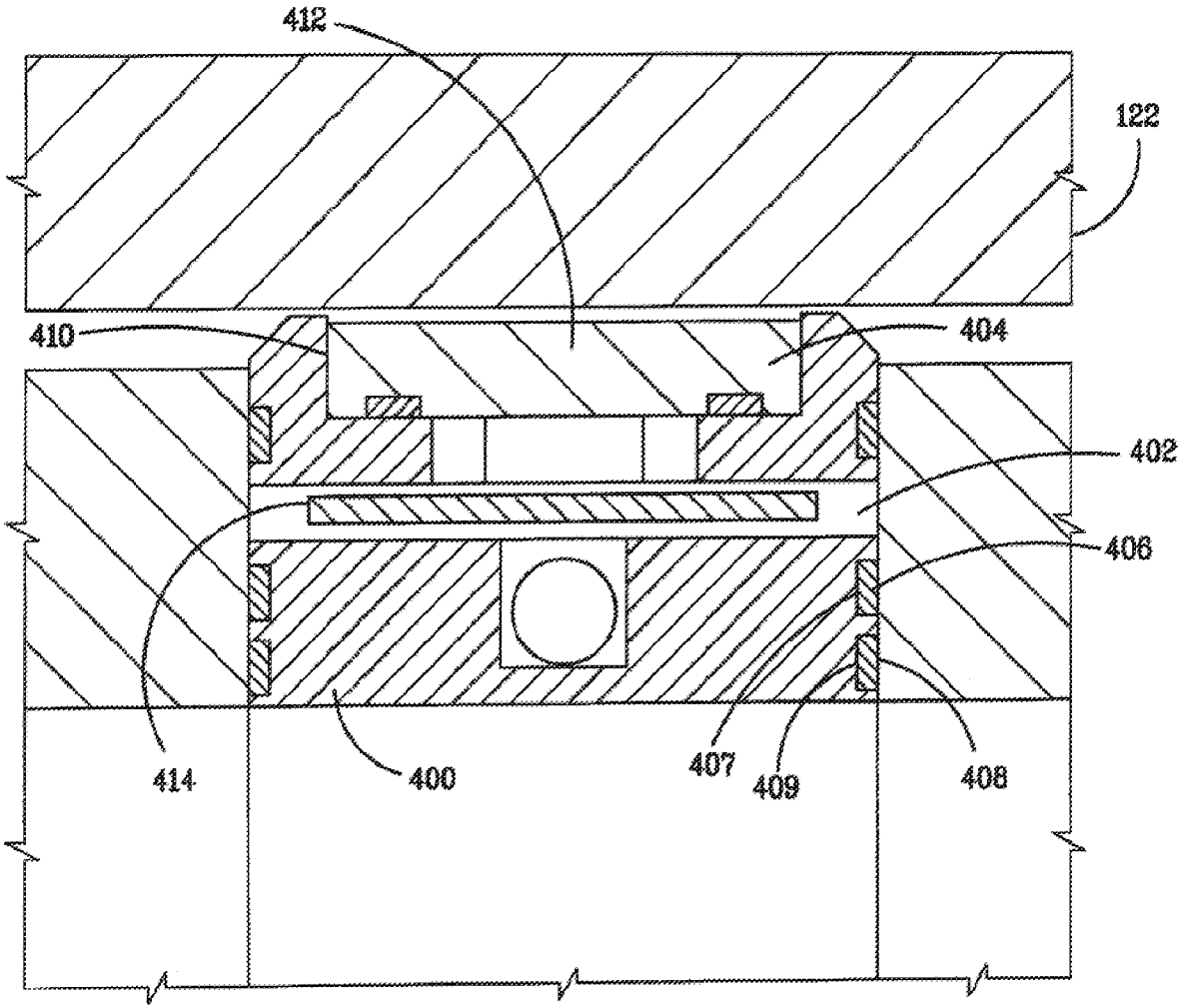
FIG. 12 is a detailed view of the sensor ring portion of FIG. 11.
Figure 13:
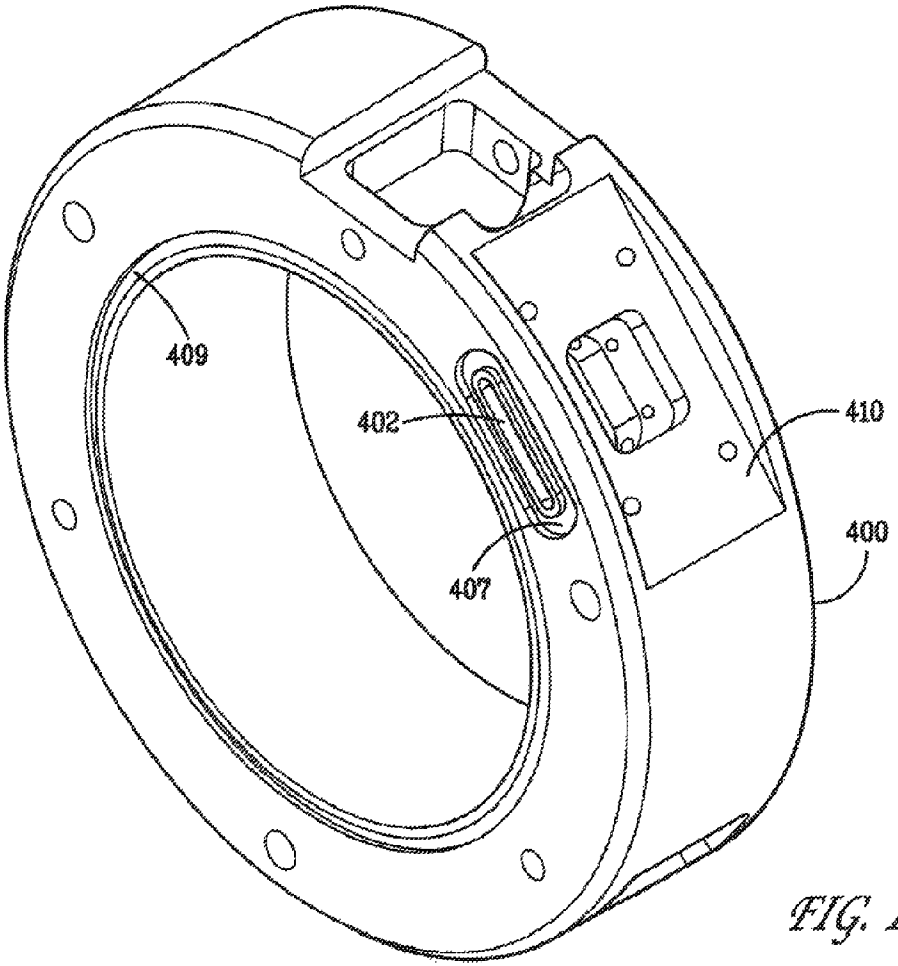
FIG. 13 is an isometric view of the sensor ring shown in FIG. 12.

FIGS. 11-13 show an embodiment incorporating the feedback loop control shown in FIG. 10. As shown in FIG. 11, in this embodiment, sensor rings 400 are placed between each pair of coil holders 146. The sensor rings 400 are preferably made from a non-magnetic material such as spinodal copper nickel tin alloy, such as Toughmet 3 available from Brush Wellman Company. As shown in FIGS. 12 and 13, a printed circuit board 414, which contains the electronics for the feedback loop control shown in FIG. 10, is mounted within a slot 402 in each sensor ring 400. The slot 402 is sealed by a race track O-ring 408 in groove 407 and a circular O-ring 408 in groove 409. A cover 412 is mounted in a recess 410 in the circumference of the sensor ring 400 that allows access to the board 414.

As used herein (i) "saturation magnetization" refers to the maximum magnetic flux density of the material such that any further increase in the magnetizing force produces no significant change in the magnetic flux density, measured in Gauss; (ii) "remanent" or "residual" magnetization or magnetic field refers to the magnetic flux density remaining in the material after the magnetizing force has been reduced to zero, measured in Gauss; (iii) "maximum remanent" magnetization refers to the remanent magnetization of a material after it has experienced saturation magnetization; (iv) "coercivity" refers to the resistance of the material to demagnetization, measured in Oersteds (Oe) and is related to the coercive force, which is the value of the magnetic force that must be applied to reduce the residual magnetization to zero; and (v) magnetic permeability refers to the "conductivity" of magnetic flux in a material, it is expressed as relative magnetic permeability, which is the ratio of the permeability of the material to the permeability of a vacuum.

To facilitate operation as described above, components of the MR valve 18 that are intended to create the remanent magnetic field—in one embodiment, the coil holders 146 and the end cap 142—are made from a material having a maximum remanent magnetism that is substantially greater than that of the 12L14 low carbon steel and 410/420 martensitic stainless steel used in prior art MR valves so that the maximum damping achieved at zero power to the coils 150 is relatively high. Preferably, the material should have a maximum remanent magnetization that is at least 12,000 Gauss. Optimally, the material has a maximum remanent magnetization that is sufficient to saturate the MR fluid—that is, that the magnetic field applied to the MR fluid by the remanent magnetization of the material is such that any further increase in the magnetic field would cause no further increase in the viscosity of the MR fluid—so as to achieve the maximum range of operation possible using remanent magnetization. Ideally, the material should have a high remanent magnetization relative to the saturation magnetization. Preferably the maximum remanent magnetization should be at least about 50%, and more preferably at least about 70%, of the saturation magnetization. Preferably, the material should also have a relatively low coercivity so that power necessary to demagnetize the components is relative low but not so low that the material will become easily unintentionally demagnetized during operation. Preferably, the material should have a coercivity in the range of at least about 10 Oe but not more than about 20 Oe, and most preferably about 15 Oe. The material should also have good corrosion resistance.

Grade 1033 mild steel, preferably with minimal impurities, which has a saturation magnetization of about 20,000 Gauss, a maximum remanent magnetization of about 13,000 to 15,000 Gauss, and a coercivity of about 10 to 20 Oe, is one example of a material suitable for use in the components of the MR valve intended to be operated as described above using primarily remanent magnetization. Ferritic chrome-iron alloys are another example of suitable materials. Examples of such ferritic chrome alloys are described in U.S. Pat. No. 4,994,122 (DeBold et al), hereby incorporated by reference in its entirety. Carpenter Chrome Core 8 alloy, available from Carpenter Technology Corporation, which has a saturation magnetization of 18,600 Gauss, a maximum remanent magnetization of 13,800 Gauss (74% of saturation) and a coercivity of 2.5 Oe may also be a suitable material for many MR valves. Other materials, also available from Carpenter Technology Corporation, that may be used are Hiperco 50A, having a relative permeability of 4000, a saturation magnetization of 23,400 Gauss, a maximum remanent magnetization of 15,000 Gauss (64% of saturation) and a coercivity of 2.3 Oe, and Hiperco 27, having a relative permeability of 2000, a saturation magnetization of 23,400 Gauss, a maximum remanent magnetization of 18,000 Gauss (77% of saturation) and a coercivity of 1.9. Oe. Silicon iron C, which has a relative permeability of about 4,000, a saturation magnetization of about 20,000 Gauss, a maximum remanent magnetization of 4000 Gauss (20% of saturation) and a coercivity of about 0.6 Oe, could also be used in some applications.

Preferably, the components of the MR valve made from the materials described above are capable of applying a magnetic field to the MR fluid, solely as a result of remanent magnetization, that is of sufficient strength to magnetically saturate the MR properties of the particular fluid.

Preferably, the shaft 100 is made at least in part from a material having a high permeability so as to facilitate magnetic flux through the MR valve. Preferably the material has a relative permeability of at least about 7000. It is also desirable for the material to have a low coercivity, preferably less than 1.0, so that it can be easily demagnetized and remagnetized as it moves within the magnetic field without creating a sufficiently strong magnetic field to demagnetize other portions of the valve. As shown in FIG. 4B, the shaft 100 can be formed with an inner shell 100A made from a corrosion resistant material, such as 410/420 stainless steel, so as to withstand contact with the drilling mud, and an outer shell 100B made from a material having a high magnetic permeance. One material that may be used for the outer shell 100B is Permalloy, which has a relative permeability of over 100,000, a saturation magnetization of about 12,000 Gauss, and a coercivity of about 0.05 Oe. A silicon iron, which a relative permeability of about 7,000, a saturation magnetization of about 20,000 Gauss and a coercivity of about 0.05 Oe, could also be used in many applications.

Although as shown in the drawings, the coil 150 is mounted in the casing 122 that transmits the drilling torque, the invention could also be practice by mounting the coils in the shaft 100. In that arrangement, at least a portion of the shaft 100 would be made from a material having a remenant magnetization of at least 12,000 Gauss and at least a portion of the casing 122 would be made from a material having a high permeance, such as Permalloy, as discussed further below.

In many instances, it would be desirable to take into account the magnetization history of the MR valve in determining the amplitude of the current to be applied to the coils in order to achieve the desired strength of the magnetic field produced by the coils and, therefore, the amount of damping achieved by the MR valve. According to one embodiment of the invention, the current to be applied to the coils is determined by a method that uses the limiting hysteresis data for the MR valve and the history of the magnetization state of the MR valve. The current supplied to the coils is measured downhole by a conventional current measuring device, such as an analog to digital converter. Although the magnetization of the MR valve could be measured directly downhole, preferably the magnetization state of the valve for each value of the current applied to the coils is tracked by the downhole firmware to predict the needed new current for new levels of magnetization.

The limiting hysteresis data for the MR valve is preferably measured directly before placing the valve in service. Preferably, a current is applied to the coils 150 and the strength of the resulting magnetic field is measured at the circumferential gap 152—that is, location at which the field is used to control the MR fluid. Preferably, the strength of the magnetic field is measured as the current is slowly raised to its maximum—that is, the current is raised until further increases in current do not result in further magnetization, in other words the current is raised until saturation is reached. The current at which this occurs is the saturation current. The current is then lowered back to zero and the polarity of the current reversed, and then again raised until magnetic saturation is reached, after which the current is again returned to zero, all the while measuring the strength of the resulting magnetic field. These measurements represent the entire limiting hysteresis loop for the MR valve.

The data collected from the first pass through this limiting hysteresis loop should not be trusted due to the unknown initial conditions of the magnetic material. However, if current is again applied to the coils in the same manner so as to make a second pass through this loop, the resulting magnetic field will follow the limiting hysteresis loop so that reliable data can be obtained. The process of raising and lowering the current while measuring the resulting magnetic field is preferably repeated several times to create a statistical average of the limiting hysteresis loop, which is made up of a series of current versus magnetization data points. Preferably, the data representative of the average limiting hysteresis loop is stored in flash memory, for example, in a memory device of the controller 134, as a permanent characteristic of the MR valve.

The second factor used to determine the current to be applied to obtain a desired magnetization in the MR valve is based on the history of magnetization state of the MR valve. This is a property that is tracked in the operation of the MR valve and can be reduced to a "stack" of "reversal points." A reversal point occurs when the direction of the change of the magnetic field has reversed—that is, the direction of strength of the magnetic field reverses from increasing to decreasing or from decreasing to increasing. This kind of reversal point need not involve changing the polarity of the applied magnetic field, only the direction in which the magnetic field is changing. Preferably, the current and magnetization of the reversal point during the operation of the MR valve are stored in a memory device in the controller 134.

FIG. 14 shows a set of assumed data from operation of an MR valve according to one embodiment of the invention. Each group of numbers on the left represents a set of data, with the first set beginning at the top and subsequent sets listed below as new operating points are achieved. The oldest point in each group is at the bottom of that group. In each data set, the values at the top of the data set represent the current operating conditions. The numbers on the right, show the progression of the history stack resulting from such operation.

The initial data set shows the valve began operation from a degaussed state and current was then increased to 3 amps, which resulted in 50 k Gauss. The second data set shows that the current was later increased to 4 amps, resulting in 60 k Gauss. Since the current continued to increase, no "reversal point" was created. The third data set shows that the current was later decreased to 3 amps, resulting in 50 k Gauss. This means that the 4 amp/60 k Gauss point now constitutes a reversal point and so is added to the "history stack" shown on the right. The remaining sets show the effect of continued operation and the fact that, after the current associated with a prior reversal point is exceeded, the prior reversal point is eliminated from the stack, indicated by the strike through. Thus, increasing the current to 5 amps in the sixth data set results in the elimination of the 4 amp reversal point from the history stack. As previously discussed, the sets of data points of current and magnetization that make up history stack, both the "real" and "what if" history stacks, are stored in memory for use in determining the current necessary to achieve a desired magnetization, as discussed below.

Figure 15A:
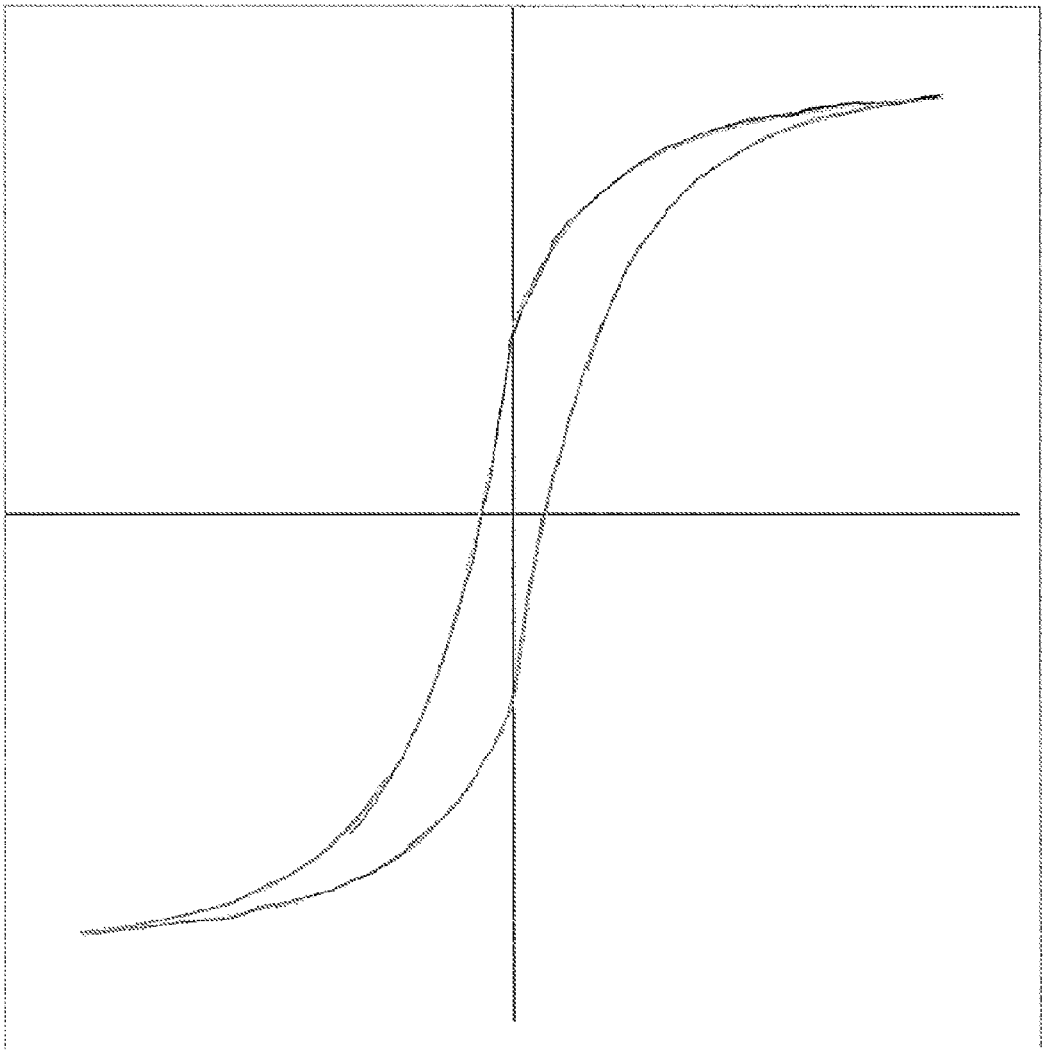
FIGS. 15A-D are graphs of magnetization, in Gauss, versus current, in amperes, showing an assumed limiting hysteresis curve for an MR valve according to the current invention and operation of the valve at various current levels.
Figure 15B:
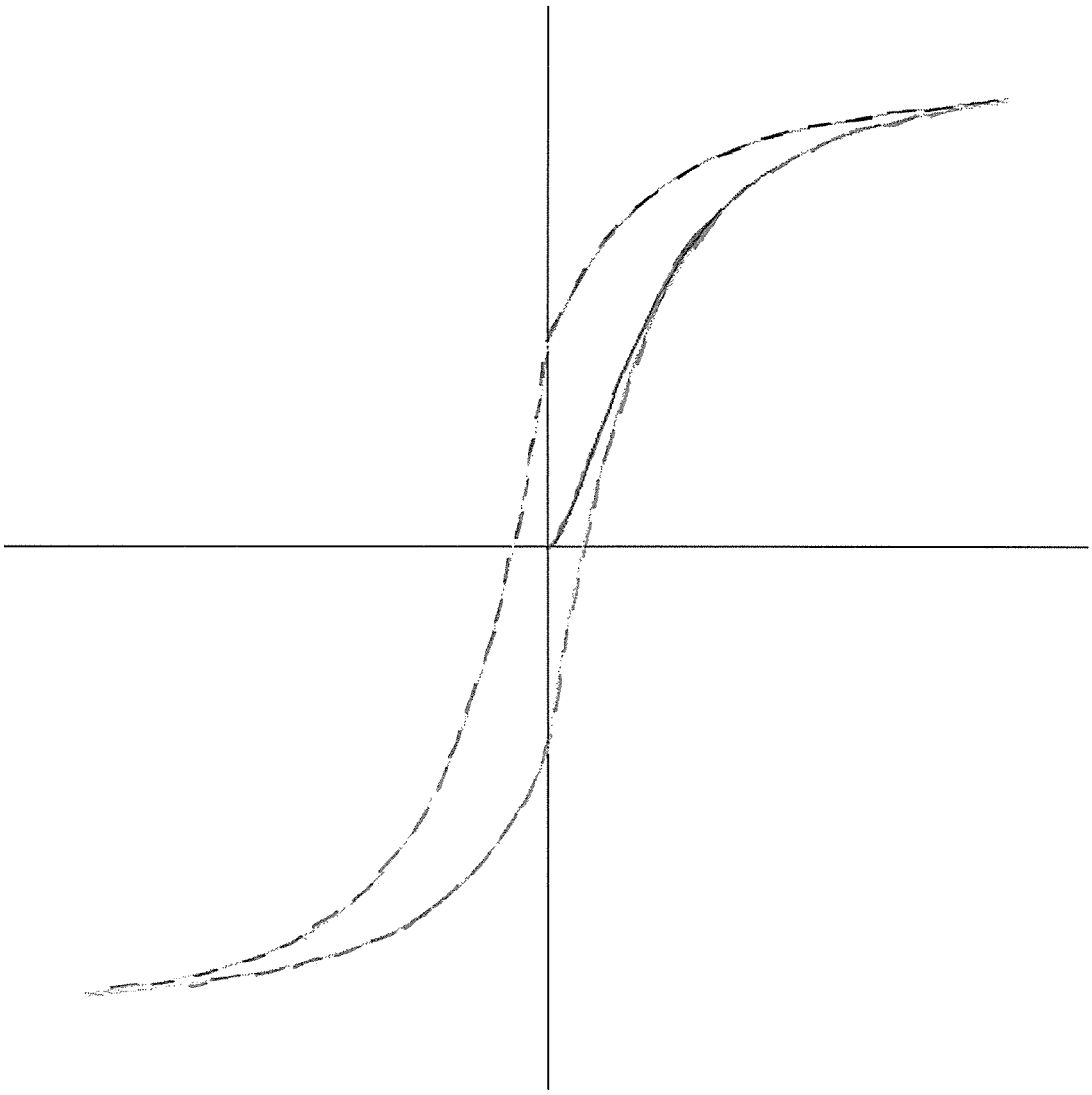
Figure 15C:
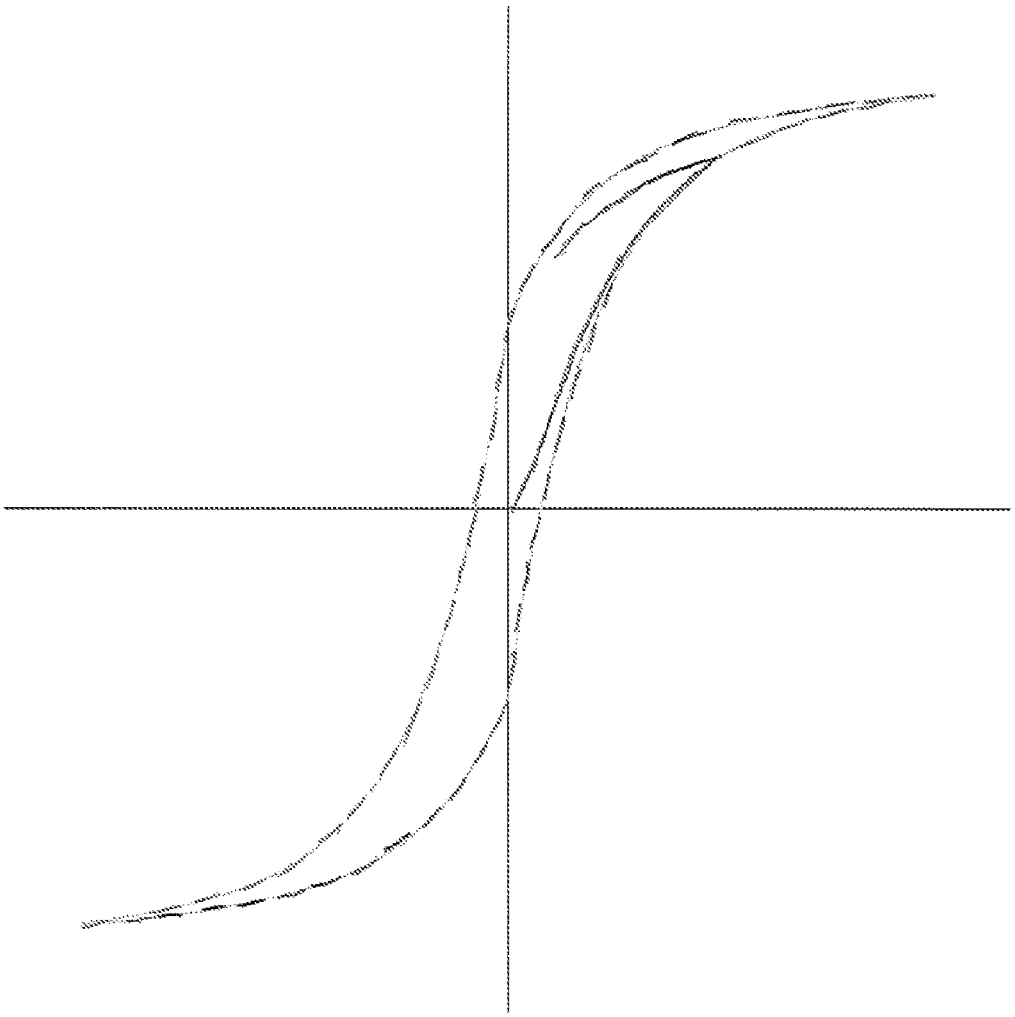
Figure 15D:
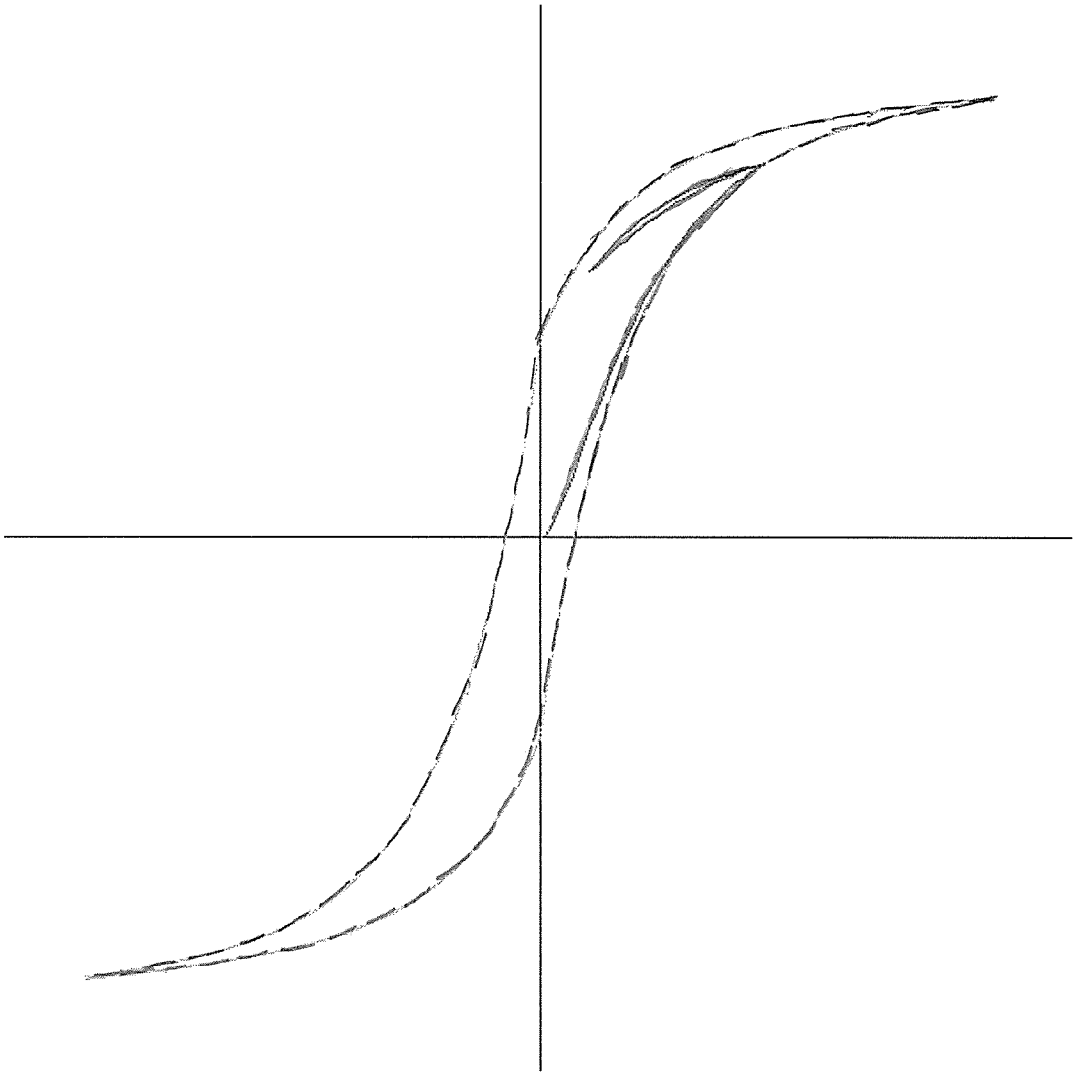

FIG. 15A is an assumed limiting hysteresis loop for an MR valve, with the y-axis being magnetic flux, or magnetization, in Gauss, and the x-axis being current, in amperes. The extreme ends of the loop represent operation at magnetic saturation. FIG. 15B shows the effect on the MR valve of increasing current to the coils, which causes an increase in magnetization to a first point on the graph, which is near the lower curve of the hysteresis loop. This curve is later referred to as "Mup" as it is the limiting hysteresis curve when the current is increasing, or going up. FIG. 15C shows the effect of decreasing current down to a second point on the graph. Due to hysteresis, the path does not follow back down the original path from the origin to the first point. Instead, as a result of remanent magnetization, the magnetization is higher for a given current level. FIG. 15D shows that if current is again increased, the valve nearly follows the path from the second point back to the first point, but is between the two prior curves. If the current continued to increase, the path would resume its path near the lower curve of the limiting hysteresis loop up to the saturation point. If the current were then decreased, the path would follow the upper curve downward. This curve is later referred to as "Mdown" as it is the limiting hysteresis curve when the current is decreasing or going down. The point at which the current was zero—in other words, when the upper curve crossed the y-axis—would represent the maximum remanent magnetization available from the valve. If, at that point, the polarity of the current were reversed and gradually increased in the negative direction, the path would follow the upper curve of the loop down to magnetic saturation at negative polarity.

According to the current invention, preferably two magnetization history stacks and variables are utilized along with the limiting hysteresis loop data. The first stack, referred to as the "real" history stack, keeps track of the state of the actual MR valve in the form of reversal points, as explained above.

Figure 16A:
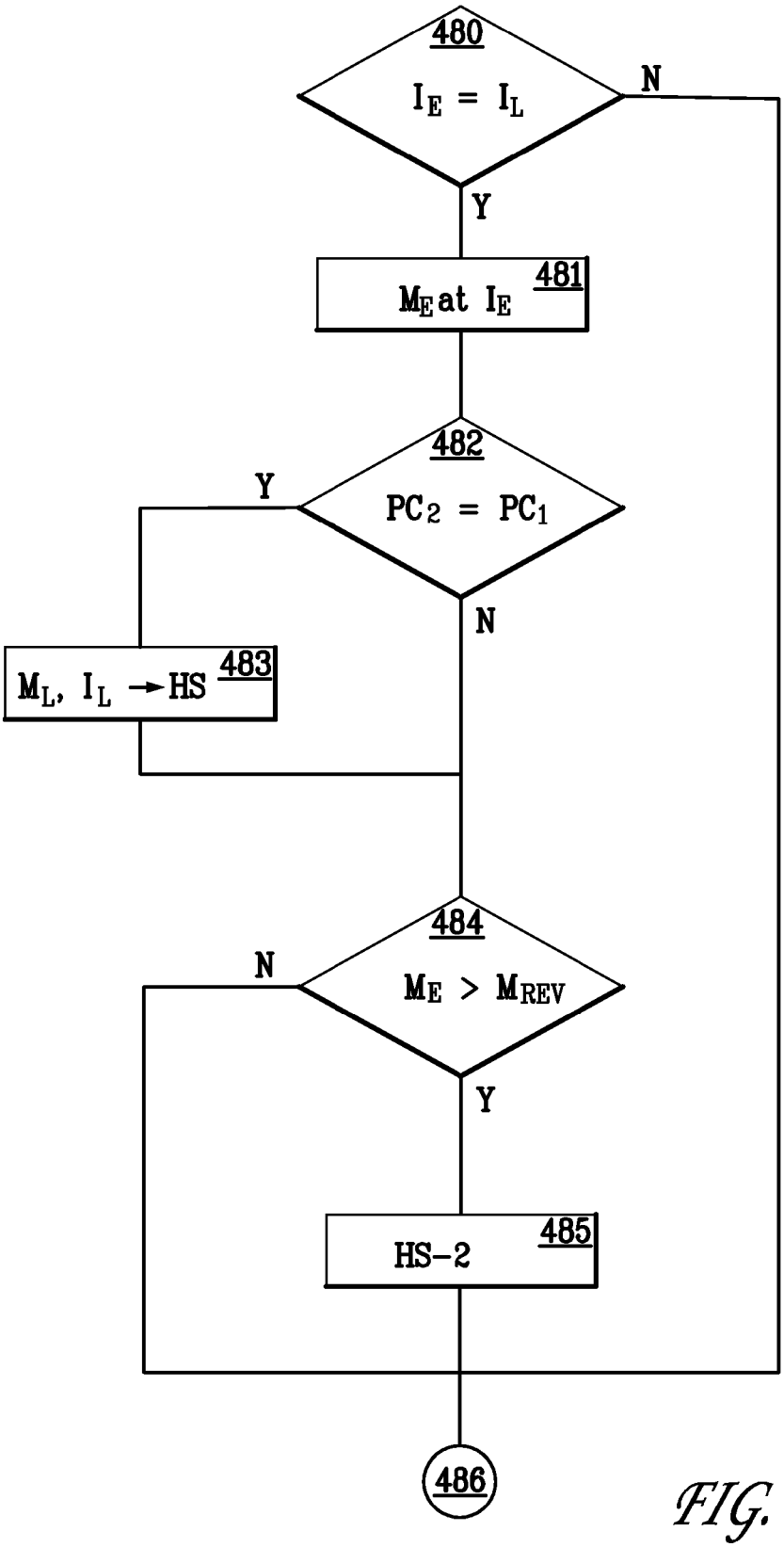
FIGS. 16A and B and 17-20 are flow charts describing a method for operating the MR valve according to one embodiment of the invention.

The method for updating the "real" history stack as the current supplied to the coils varies during operation of the MR valve is shown in the flowchart in FIG. 16A, and is preferably implemented in software stored in a processor in the controller 134, In step 480, the existing current supplied to the coils $I_E$ is measured and compared against the value of the current $I_L$ obtained in the prior measurement to determine whether the current has changed. Preferably, this check is performed periodically at very short time intervals. If the current has not changed, the method returns at step 486 to await the next current measurement. If the current has changed, then in step 481 the magnetization of the MR valve is determined based on the new current $I_E$ and the "real" history stack using the same methodology that is used to determine the magnetization that results from test currents that is explained below. In particular, and as explained in detail below, the method of calculating magnetization used in step 481 is set out in steps 612, 614 (shown in FIG. 17) and steps 700-706 (shown in FIG. 18) if there are reversal points in the real history stack, while the method used is set out in steps 612, 614, 620-624 (FIG. 17) and steps 800-804 (FIG. 19) if there are no reversals in the real history stack, except that for purposes of updating the real history stack based on the current supplied to the MR valve, the existing "real" history stack is used, instead of the "what if" history stack that is used for purposes of determining the current necessary to achieve a given level of magnetization, as discussed below.

In step 482, the direction of the change from the existing current $I_E$ to the last current $I_L$, $PC_2$, is compared to the direction of the change in current, $PC_1$, that was last used to calculate a magnetization for the MR valve. For example, if the last prior two currents that were applied to the coils were 0 amps and 2 amps, the old direction was increasing; then if the new current was 1 amp, the change from 2 amps to 1 amp is decreasing, giving a reversal or change in direction of the change in current.

If a reversal of the direction of change of current has occurred, the old current and magnetization $M_L$ and $I_L$ are pushed onto the top of the real history stack in step 483. Step 484 determines whether the new magnetization $M_E$, calculated as explained above, has gone past the value of $M_{REV}$, the magnetization on the top of the "real history" stack, and closed a loop by being greater than $M_{REV}$ if the current is increasing and less than $M_{REV}$ if the current is decreasing. If it has, then in step 485, the last two reversal points are removed from the "real" history stack. By continually performing the method discussed above, the real history stack reflects the magnetization history of the MR valve as the current varies during operation.

The second stack is used as a "what if" stack to test predictions of the magnetization that will result from new currents. As discussed more fully below, incremented values of a "test current" are used in the calculation of the current necessary to result in a desired magnetization. For each succeeding valve of the test current, the "what if" stack is initially set to be the "real" history stack. The "what if" stack is then updated to include a test current and its resulting calculated magnetization if the test current creates a reversal point. There are also both "real" and "what if" variables to keep track of support parameters like the last current used to calculate a magnetization, and the last magnetization calculation result. All variables are initialized to 0 before starting this system. When a new magnetization state is desired, a "binary search" of possible currents to achieve the new magnetization is conducted, which includes copying the "true" history stack to the "what if" history stack. When the system first starts, the data for the measured limiting hysteresis has been stored in a memory device, preferably in permanent memory, and all stacks and variables are cleared to zero. As discussed above, the current being applied to the MR valve coil is continually measured and monitored. Any changes in current triggers the calculation of a new magnetization using the "real" stack and variables. This calculation compares the new current with the existing current to determine the direction of change of the current. This direction of change is then compared with the last direction of change of current to determine how the new magnetization is to be computed. If the present change of current is the same as the previous change of current, no new reversal point is created. If no direction reversals have occurred, the calculated magnetization will still be the initial magnetization. The new magnetization for the new current is then calculated according to the present direction of change of current, and the last reversal point, if any. These calculations are done using the "real" stack and variables so that those values will always represent the "starting point" for any desired changes in magnetization.

When the rig operator or the controller 134, or other control system, determines the need of a change in magnetization, the method of the current invention determines the best current for achieving the desired magnetization using a binary search. First the direction of the desired change is determined A current is chosen which is half way between the present current and maximum possible current in the desired direction. The change in current required to achieve this "half way" point is called the "incremental current" and can be either positive or negative. The current needed for this "half way" point is called the "Test Current." Then the "real" stack and variables are copied to the "what if" stack and variables. Then the magnetization calculations are performed using these "what if" variables. This involves making a predicting for "what if we change the magnetization from its present operating current to a current at the half way point or test current." The resultant magnetization is then compared with the desired magnetization, and the "incremental current" is cut in half. If the resultant magnetization did not achieve the desired magnetization, this new "incremental current" is added to the Test Current. If the resultant magnetization went beyond the desired magnetization, this new "incremental current" is subtracted from the Test Current. The "real" stack and variables are again copied to the "what if" stack and variables to "reset" the start conditions for making the prediction. The magnetization calculations are performed again using the revised Test Current and the reset "what if" stack and variables. Again the resultant magnetization is compared with the desired magnetization, and the "incremental current" is cut in half. This search process is preferably repeated until the incremental current is divided below the resolution of the system for measuring current, or either the "incremental current" or the difference between the result and desired magnetization fall below a predetermined error limit.

The method for determining the new magnetization depends on the polarity of both the "old" and "new" current, and the direction of change of current both now and in the past. These factors are stored in variables called either "real" or "what if", but the method for computing the magnetization is the same for both kinds of variables. In a preferred embodiment, the new magnetization is computed using a method described by Jian Guo Zhu, M. Eng. Sc., B.E. (Elec.) University of Technology, Sydney, July, 1994, in his thesis "Numerical Modelling Of Magnetic Materials For Computer Aided Design Of Electromagnetic Devices," hereby incorporated by reference herein in its entirety. However, it is also possible to compute this magnetization with other methods, though those other methods may call for different variables to be separated as "real" and "what if" to implement the binary search method described above.

Figure 16B:
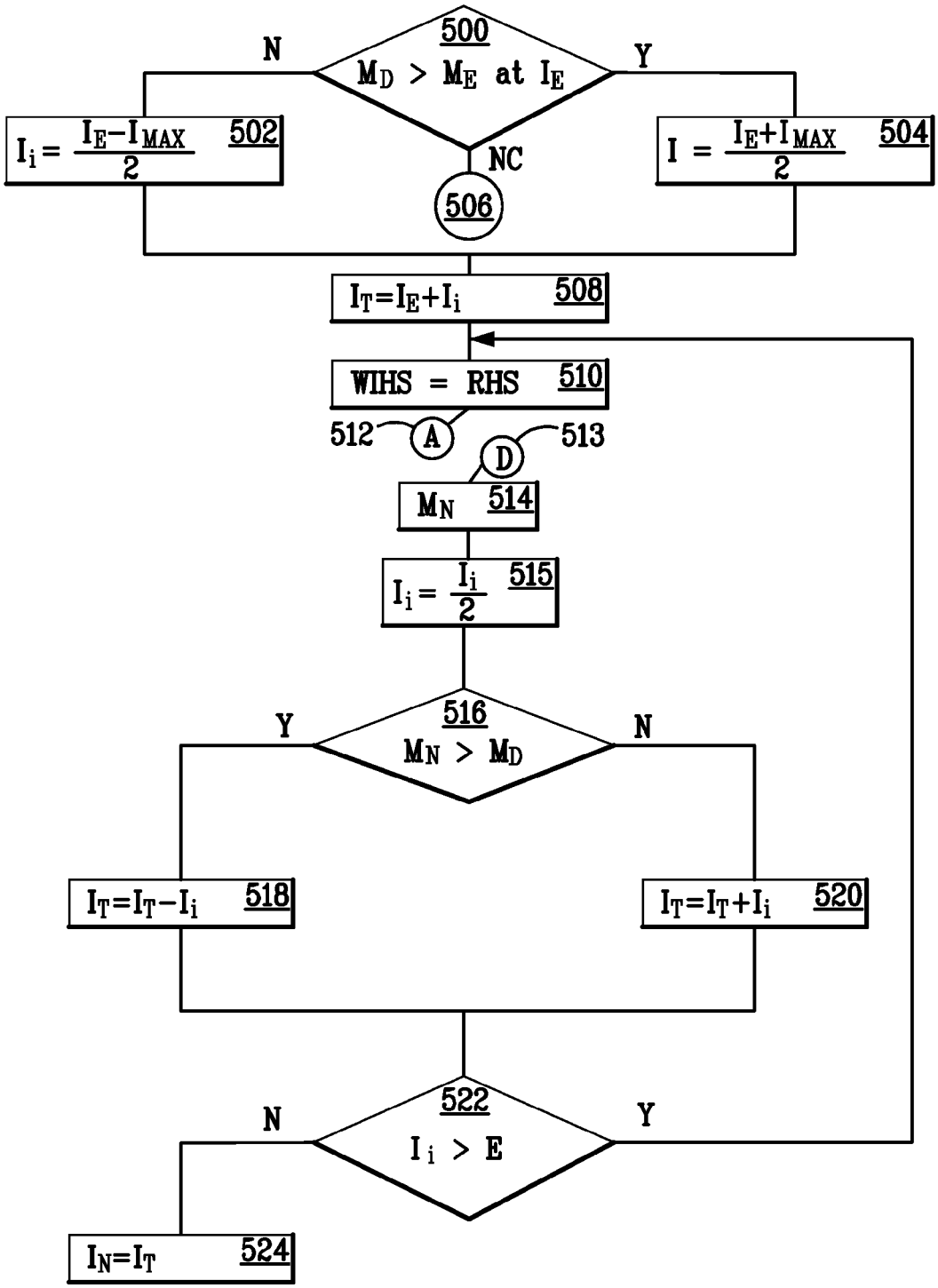

The method for determining the current required to achieve a desired magnetization, which is preferably implemented in software stored in a processor in the controller 134, will now be explained by reference to the flow charts illustrated in FIGS. 16B-20. As shown in FIG. 16B, in step 500, a determination is made as to whether the newly desired magnetic field $M_D$ is greater than, less than, or equal to, the existing magnetic field $M_E$ that results from the existing current $I_E$ being applied to the coils. The existing current will be zero if the MR valve were being operated using only remenant magnetization. If it is determined in step 500 that the desired magnetic field is neither greater than nor less than—in other words, is equal to—the existing magnetic field, then the method returns in step 506 because no change in current is required. Otherwise, in steps 502 or 504 a current increment is selected given the direction of the change between the existing magnetization $M_E$ and the desired magnetization $M_D$. Specifically, $I_i$ is set half way between (i.e., the average of) the existing current $I_E$ and the maximum current, in either positive or negative polarity (as determined in step 500), that the power source for the MR valve is capable of generating.

Figure 17:
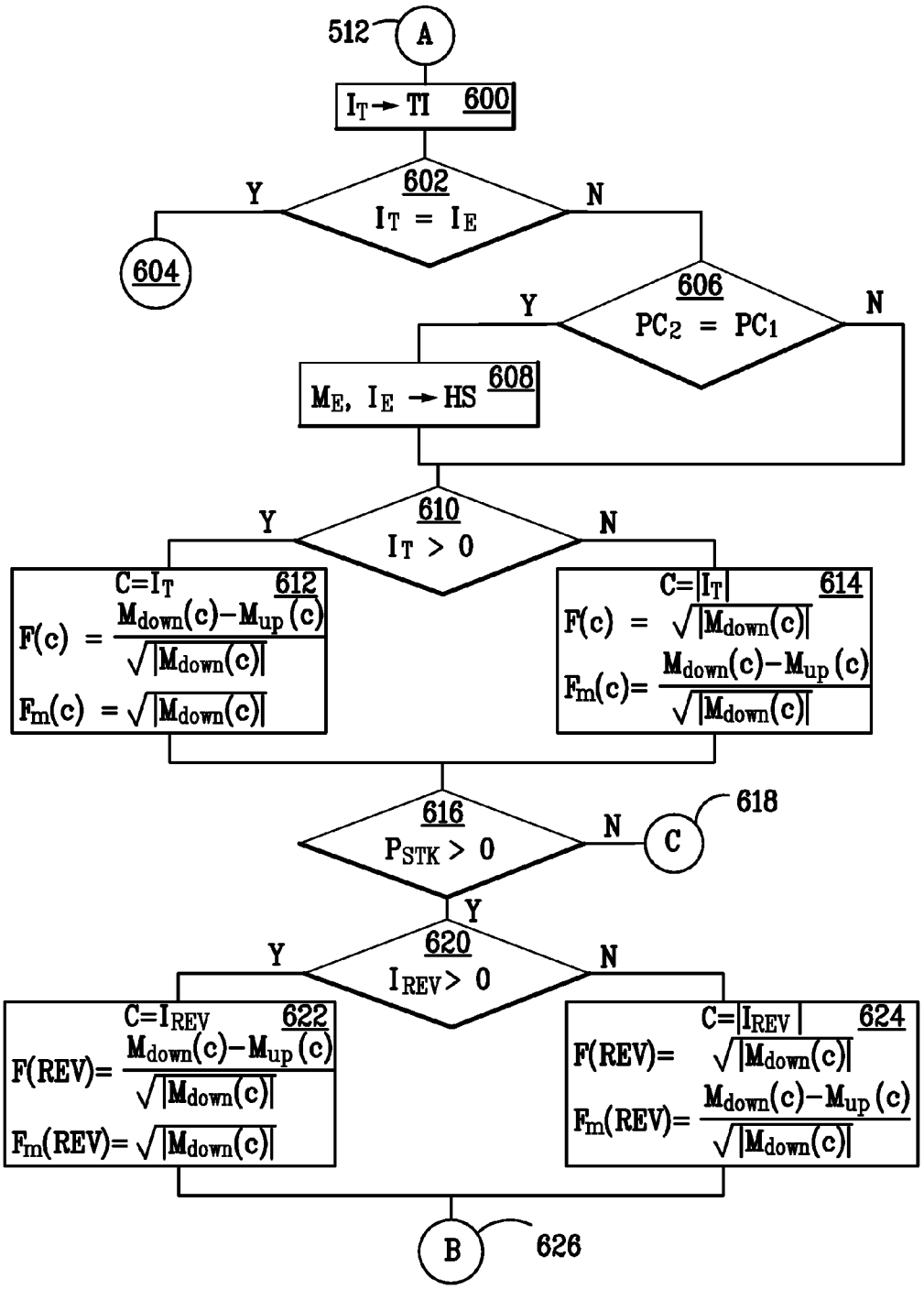

In step 508, a test current $I_T$ is determined by adding the current increment $I_i$ to the existing current $I_E$. In step 510, the "real" hysteresis stack, created as discussed above, is copied to a "what if" hysteresis stack that is used in performing this test. In step 512, the method moves to the flow chart shown in FIG. 17 at point A. As shown in FIG. 17, in step 600, the test current $I_T$ is converted to the table index used to access the data in the limiting hysteresis curve data. For example, in one embodiment, the current is represented by integer values from 0 to 1023 and the magnetization is represented by 0 to 20,000. Step 602 checks whether the test current $I_T$ is equal to the current the last used to calculate magnetization. If it is, no change in current is needed and the method returns at step 604. If it is not, then in step 606, the direction of the change from the existing current $I_E$ to the test current $I_T$, $PC_2$, is compared to the direction of the change in current, $PC_1$, that was last used to calculate a magnetization. For example, if the last prior two currents were 0 amps and 2 amps, the old direction was increasing; then if the new current was 1 amp, the change from 2 amps to 1 amp is decreasing, giving a reversal or change in direction of the change in current.

If a reversal of the direction of change of current has occurred, the old current and magnetization are pushed onto the top of the "what if" history stack in step 608.

Step 610 determines whether the test current $I_T$ is positive. If it is, then F(c), which can be referred to as the first partial change in the field, and Fm(c), which can be referred to as the second partial change in the field, are determined from the data from the limiting hysteresis loop using the equations indicated in step 612. If the test current is negative, then F(c) and Fm(c) are determined by inverting the data representing the limiting hysteresis loop and using the equations indicated in step 614. In connection with the equations in steps 612 and 614, Mdown(c) is the value of the magnetization of the upper curve of the limiting hysteresis loop (which is traversed when the current is going down) at the test current $I_T$, and Mup(c) is the magnetization of the lower curve of the limiting hysteresis loop (which is traversed when the current is going up) at the test current $I_T$.

Step 616 determines if there are any reversal points on the "what if" history stack. If step 616 determines that there are no reversals in the "what if" history stack, then the method is continued based on the flow chart shown in FIG. 18 at point C, discussed below. If there is at least one reversal in the "what if" history stack, then, after determining whether the current is positive or negative in step 620, the use of the equations to calculate F(c) and Fm(c) are repeated in steps 622 and 624 to determine F(REV) and Fm(FEV), which are based on the values of Mdown(REV) and Mup(REV) from the limiting hysteresis loop at the current $I_{REV}$ associated with the most recent reversal point on the "what if" history stack. After step 622 or 624 is performed, the method is continued based on the flow chart shown in FIG. 19 at point B.

Figure 19:
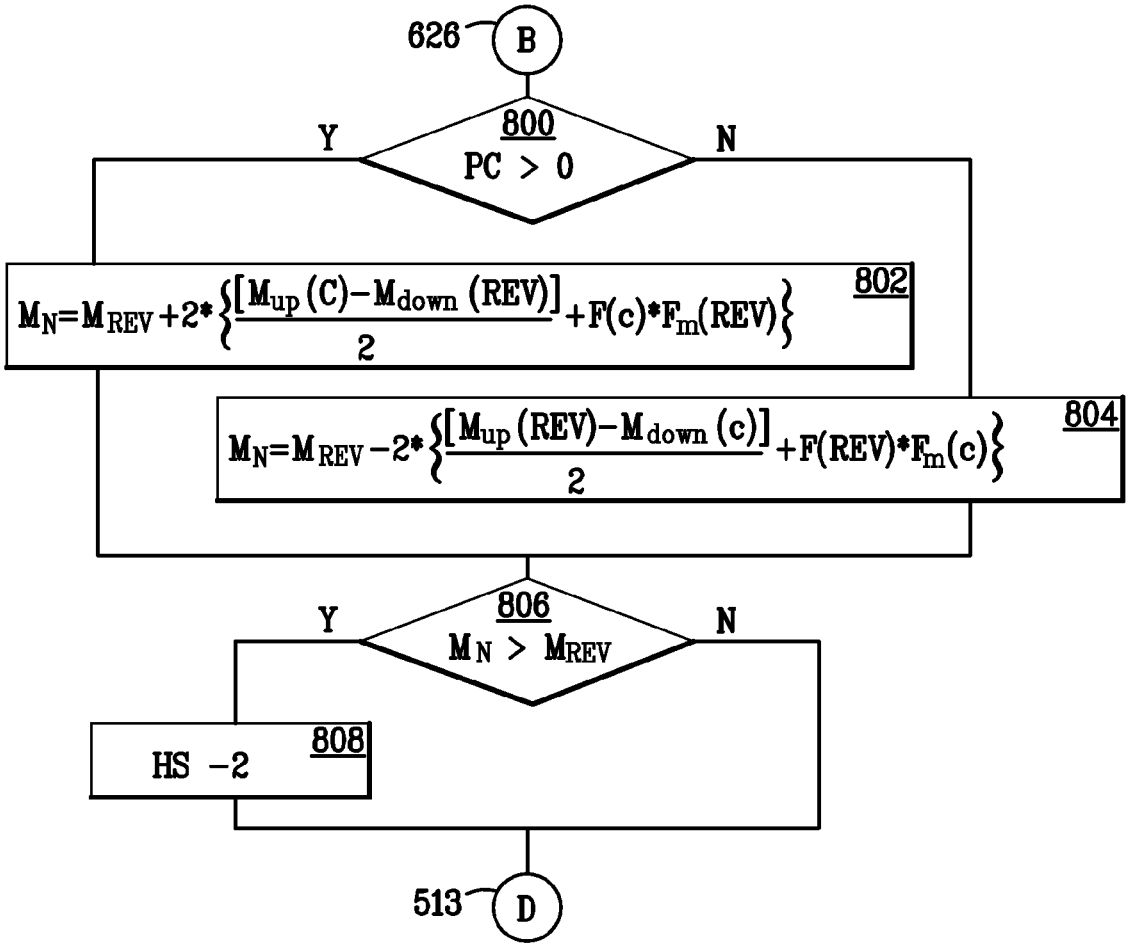
Figure 20:
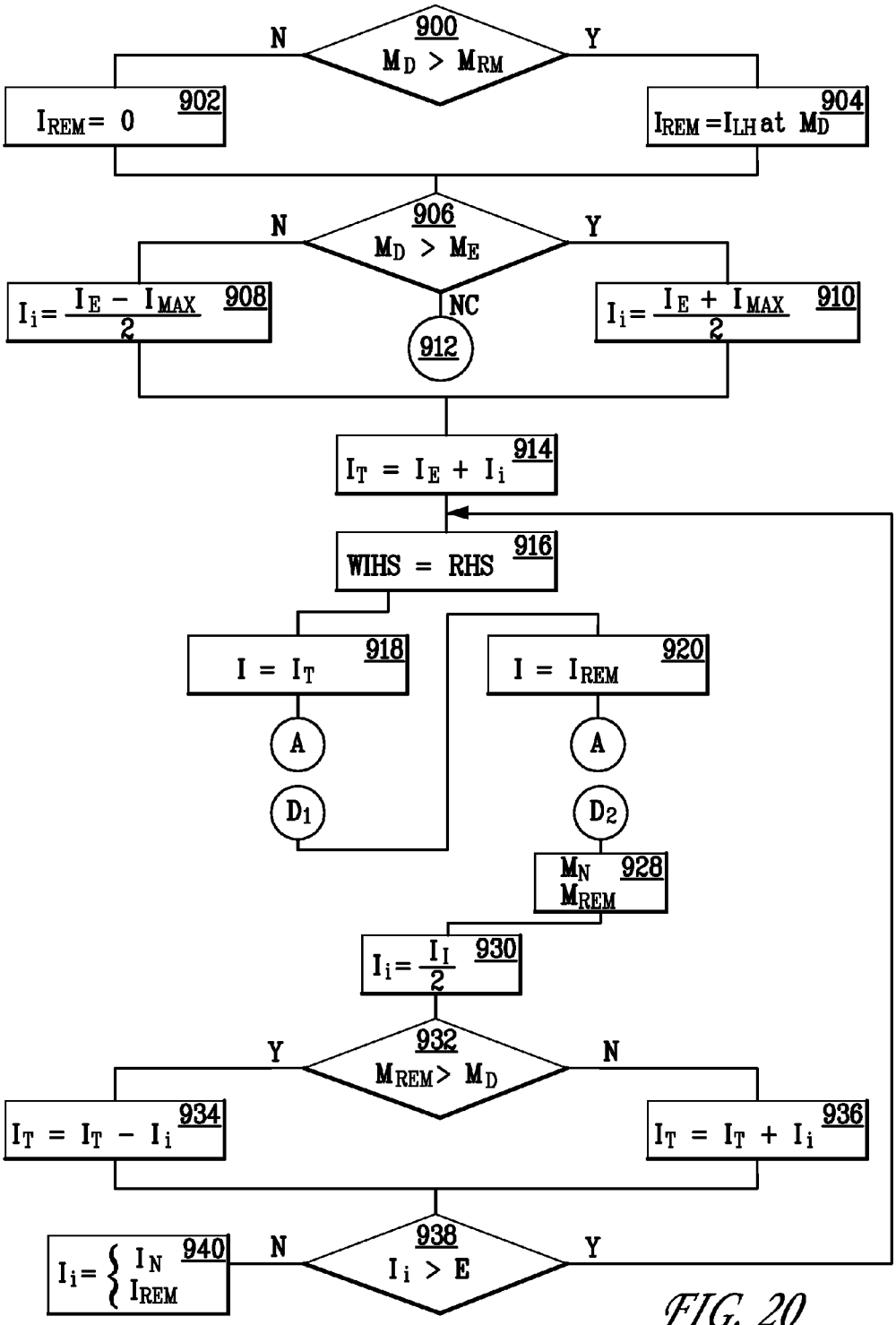

As shown in FIG. 19, after steps 622 and 624, a determination is made in step 800 as to whether the polarity of the change from the existing current $I_E$ to the test current $I_T$ is positive—that is, does the value of the test current calculated in step 508 represent an increase over the existing current $I_E$, in which case the polarity of the change is positive, or a decrease, in which case the polarity of the change is negative. If the polarity of the change is positive, then a new magnetization $M_N$ is calculated as indicated in step 802, whereas if it is negative, then the new magnetization $M_N$ is calculated as indicated in step 804, where:

c=the test current.

$M_{REV}$=the magnetization of the last reversal point found on the top of the stack.

Mup(c) and Mdown(c)=the value of the magnetization while current is increasing and decreasing, respectively, stored in permanent memory for the current c.

Mup(REV)=the value of the magnetization while current is increasing, stored in permanent memory, for the current $I_{REV}$.

Mdown(REV)=the value of the magnetization while current is decreasing, stored in permanent memory, for the current $I_{REV}$.

F(c), Fm(c)=the values calculated in steps 612 or 614.

F(REV), Fm(REV)=the values calculated in step 622 or 624.

Note that Mup and Mdown are lists of numbers stored in permanent memory as a characteristic of the tool. The terms "c" or "REV" denote the current for which we wish to fetch this value. In one embodiment these lists have 1024 elements each. The current of 0-4 amps is converted to a number 0-1023 by multiplying it by 256. This then becomes the index into the arrays Mup and Mdown.

Step 806 determines whether the new magnetization $M_N$, calculated as explained above, has gone past the value of $M_{REV}$, and closed a loop by being greater than $M_{REV}$ if the current is increasing and less than $M_{REV}$ if the current is decreasing. If it has, then in step 808, the last two reversal points are removed from the "what if" history stack. The method then returns to the main flow chart shown in FIG. 16B, at D, with the value of $M_N$ calculated in steps 802 or 804.

Figure 18:
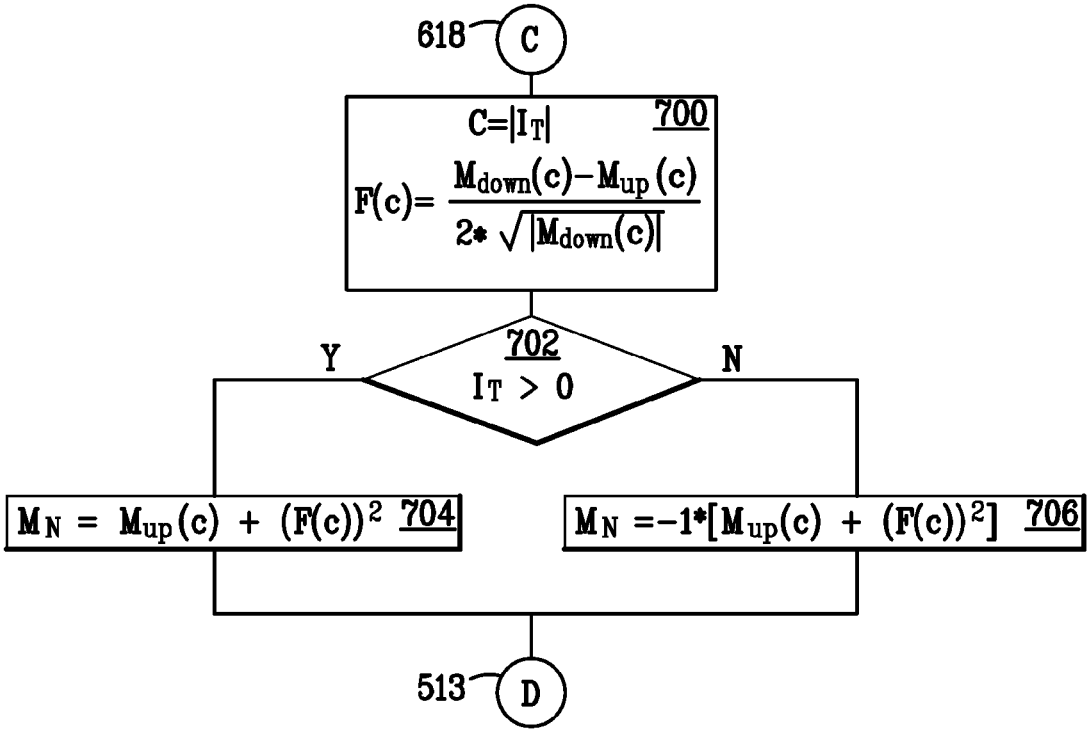

If in step 616 of the flow chart shown in FIG. 17 it was determined that there were no reversals in the "what if" history stack, then the flowchart shown in FIG. 18 is entered at C and, in step 700, F(c) is calculated from the indicated equation using the magnetization values of the upper and lower curves of the limiting hysteresis loop—Mdown(c) and Mup(c)—at the value of the test current $I_T$. Next, step 702 determines whether the test current $I_T$ is positive. If this is the initial pass through of the algorithm, the value of the test current $I_T$ will be as determined in step 508 in FIG. 16B. However, in subsequent passes the test current $I_T$ will have been reset in steps 518 or 520. In any event, if the test current $I_T$ is positive then a new magnetization is calculated as indicated in step 704, whereas if it is not, the new magnetization is calculated as indicated in step 706, where:

Mup(c)=the value of the magnetization associated with the upper limiting hysteresis curve at a current of $I_T$.

F(c)=the value calculated in step 700.

Following steps 704 or 706, the method then returns to the main flow chart shown in FIG. 16B, at D, with the value of $M_N$ calculated in steps 704 or 706.

Upon return to the main flow chart shown in FIG. 16B at point D, from either FIG. 18 or 19, step 513 is entered using a value of the new magnetization $M_N$ calculated as described above. In step 515, a new incremental current $I_i$ is set as one half the prior incremental current. Step 516 determines whether the new magnetization $M_N$ is greater than the desired magnetization $M_D$. If it is, then a new test current $I_T$ is determined in step 518 by subtracting the new incremental current $I_i$ from the previous test current. If the new magnetization $M_N$ is less than the desired magnetization $M_D$, then the new test current $I_T$ is determined in step 520 by adding the new incremental current $I_i$ to the previous test current.

Step 522 determines whether the new incremental current $I_i$ is greater than a selected error amount. The error amount can be selected in various ways depending on the precision desired. As one example, if the values of current are represented by integers from 0 to 1023, then the error value may be set at 1/1023. In any event, if the incremental current is greater than the error value, then step 510 and the succeeding steps are repeated using the new value of test current $I_T$ calculated in steps 518 or 520. If the incremental current is less than the error value, then the new value for the current to be supplied to the coils $I_N$ in order to obtain the desired magnetization $M_D$ is set as the new value of test current $I_T$ calculated in steps 518 or 520. This value of the current could either be reported to the rig operator for manual adjustment by the operator or the current to the coils could be automatically adjusted by the controller 134. If the new value of the current represents a reversal point, it is added to the "real" history stack when that new current is realized by the hardware.

Using the method described in the flow charts in FIGS. 16-19, the MR valve can be operated in the course of drilling a bore hole in an efficient manner. In particular, when a new desired level of magnetization $M_D$ for the MR valve is identified in order to obtain a desired amount of damping, the method is employed to calculate the new value of the current to be supplied to the coils in order to obtain that magnetization. According to the method, if the newly desired level of magnetization is less than the remanent magnetization of the MR valve, the MR valve need not be completely, or even partially, demagnetized using an alternating pulse regime such as that shown in FIG. 7. Rather, the method discussed above will provide the value of the current to be applied, which may be reverse polarity current, to the coils that will result in the desired level of magnetization, whether or not the desired level is less than the existing remanent magnetization. Essentially, the MR valve can be directly demagnetized sufficiently to achieve the desired level of magnetization. This has the advantage of saving power and achieving the new magnetization quickly when compared to demagnetizing using alternating pulses. The method described above can also be applied to operation that relies, to the extent possible, on remanent magnetization of the MR valve, thereby decreasing the power required to operate the valve and increasing, for example, battery life. With reference to the flow chart illustrated in FIG. 20, in step 900, the newly desired magnetization $M_D$ is compared to the maximum remanent magnetization that can be obtained by the MR valve $M_{RM}$. The value of the maximum remanent magnetization $M_{RM}$ can be determined from the limiting hysteresis loop since it represents the value of the magnetization of the upper curve at zero current. In other words, it is the remanent magnetization that would result if the current were increased to magnetic saturation and then decreased to zero.

If the desired magnetization $M_D$ is not greater than the maximum remanent magnetization $M_{RM}$, meaning that operation solely on remanent magnetization is possible, then the "remanent" current $I_{rem}$ is set to zero in step 902, since no current will be necessary to achieve the desired magnetization once the appropriate amount of remanent magnetization has been induced. If the desired magnetization $M_D$ is greater than the maximum remanent magnetization $M_{RM}$, meaning that operation solely on remanent magnetization is not possible, then the "remanent" current $I_{rem}$ necessary to achieve the desired magnetization $M_D$ is determined in step 904 as the current associated with the desired magnetization on the upper curve of the limiting hysteresis loop, which is the limiting hysteresis of the downward trajectory (or the limiting hysteresis when the current is decreasing).

In step 906, a determination is made as to whether the newly desired magnetic field $M_D$ is greater than, less than, or equal to, the existing magnetic field $M_E$ that results from the existing current $I_E$ being applied to the coils, which will be zero if the MR valve were being operated using only remenant magnetization. If it is determined in step 906 that the desired magnetic field is neither greater than nor less than—in other words, is equal to—the existing magnetic field, then the method returns in step 912 because no change in current is required. Otherwise, in steps 908 or 910 a current increment $I_i$ is selected given the direction of the change between the existing magnetization $M_E$ and the desired magnetization $M_D$. Specifically, $I_i$ is set half way between (i.e., the average of) the existing current $I_E$ and the maximum current, in either positive or negative polarity (as determined in step 906), that the power source for the MR valve is capable of generating.

In step 914, a test current $I_T$ is determined by adding the current increment $I_i$ to the existing current $I_E$. In step 916, the "real" hysteresis stack, created as discussed above, is copied to a "what if" hysteresis stack that is used in determining the new current for the desired magnetization. The method then continues at A in FIG. 17, followed by the method set out in FIGS. 18 and 19, using as the value of the current the value of the test current $I_T$ determined in step 914, as reflected by step 918, similar to what was done in connection with the use of these flow charts discussed above, and the method returns to the flow chart in FIG. 20 from the flow charts in FIG. 18 or 19, as the case may be, at point D1 having determined a value for the magnetization $M_N$ at the test current $I_T$.

The value of the current to be used in the succeeding calculations is then set at $I_{rem}$, as reflected in step 920, and the method described in the flow charts illustrated in FIGS. 7-19 is again performed but this time using as the value of the current the value of the remanent current $I_{rem}$ determined in steps 900-904. The method then returns to the flow chart in FIG. 20 from the flow charts in FIG. 18 or 19, as the case may be, at point D2 having now determined a value for the magnetization $M_{rem}$ at the current $I_{rem}$, as well as the magnetization $M_N$ at $I_T$ discussed above, as reflected in step 928.

In step 930, the value of the incremental current $I_i$ is halved. Step 932 then determines whether the calculated value of remanent magnetization $M_{rem}$ is greater than the desired magnetization $M_D$. If it is, then a new test current $I_T$ is determined in step 934 by subtracting the new incremental current $I_i$ from the previous test current. If the new magnetization $M_{rem}$ is not greater than the desired magnetization $M_D$, then the new test current $I_T$ is determined in step 936 by adding the new incremental current $I_i$ to the previous test current.

Step 938 determines whether the new incremental current $I_i$ is greater than a selected error amount. If the incremental current is greater than the error value, then step 938 and the succeeding steps are repeated using the new value of test current $I_T$ calculated in steps 934 or 936. If the incremental current is less than the error value, then the test current $I_T$ represents the current to be initially supplied to the coils so that, after a sufficient period of time, the current can be reduced to $I_{rem}$ and the MR valve operated at current $I_{rem}$, which may be zero if operation solely on remanent magnetization is possible but, in any event, will be less than if the MR valve had been completely demagnetized before adjusting the current to the achieve the newly desired magnetization.

Figure 21:
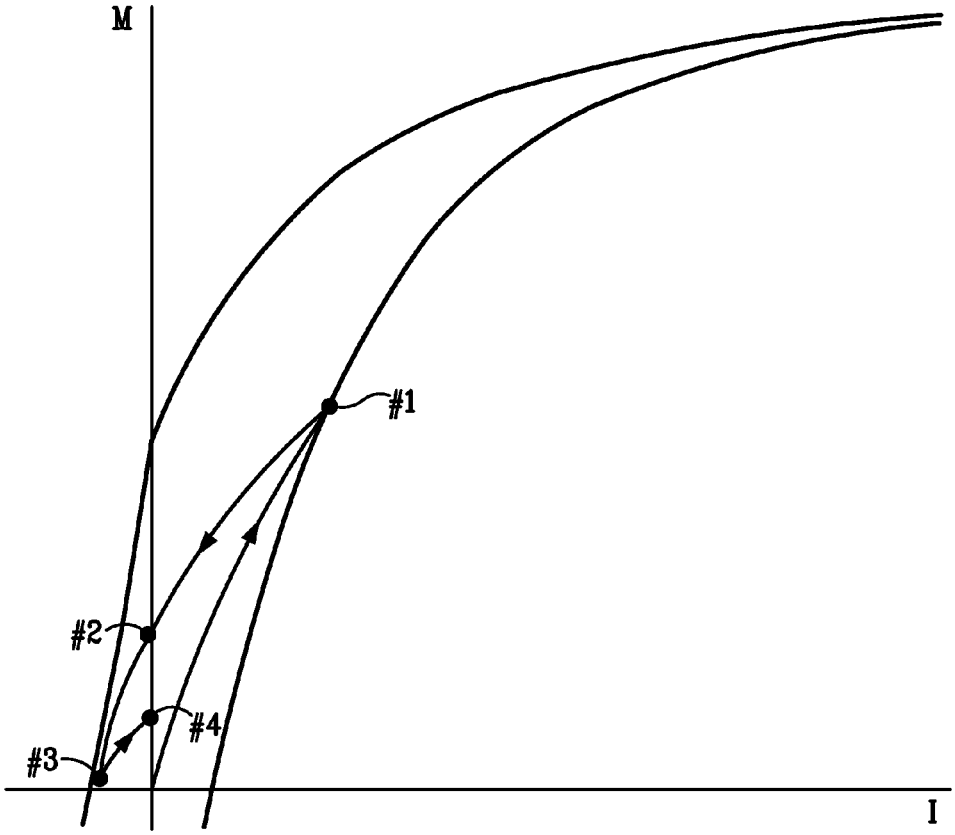
FIG. 21 shows an assumed limiting hysteresis curve for an MR valve and operation of the valve according to one embodiment of the current invention.

Operation of an MR valve using the method described above is depicted in FIG. 21, which shows the upper portion of an assumed limiting hysteresis curve for an MR valve. It is assumed that, initially, there is no remanent magnetization in the valve. As an example, assume that, initially, a magnetization of 3000 Gauss were desired to obtain the desired damping from the valve. The method described above would report that the initial test current $I_T$ should be 0.88 Amp and that the subsequent remanent current $I_{rem}$ can be zero. Following this instruction would result in operation at point #1, at which the current was 0.88 Amp and the magnetization was 11,285 Gauss, followed, after sufficient time for remanent magnetization to be induced, by operation at point #2, in which the current was decreased to zero and the remanent magnetization alone resulted in the desired magnetization of 3000 Gauss. In this situation, the 0.88 amps/11,285 Gauss point would represent the first reversal point on the history stack.

If, after further operation, it were desired to operate at 1000 Gauss, demagnetization would be required. The method discussed above would determine that the test current $I_T$ to which the current should initially be set would be a "discharging current" of −0.11 amps, which resulted in a magnetization of 356 Gauss (indicated as point #3), followed by a reduction in the current to the value of the remanent current $I_{rem}$ of 0 amps, which would allow the MR valve to operate at point #4 at which the remanent magnetization is 1000 Gauss, as desired.

Operation using the method described above ensures that full advantage is made of remanent magnetization since the MR valve is preferably only demagnetized to the extent necessary to achieve the desired magnetization. If the desired magnetization is less than the existing remanent magnetization will permit, this method avoids fully demagnetizing the valve and then increasing the current to the value necessary to achieve the desired magnetization without the benefit of remenant magnetization. Rather, according to the method described above, operation relying solely on remanent is still achieved by directly reducing the amount of remanent magnetization.

Although the invention has been described with reference to a drill string drilling a well, the invention is applicable to other situations in which it is desired to control damping. Accordingly, the present invention may be embodied in other specific forms without departing from the spirit or essential attributes thereof and, accordingly, reference should be made to the appended claims, rather than to the foregoing specification, as indicating the scope of the invention.

What is claimed is:

1. A method of damping vibration in a downhole portion of a drill string drilling into an earthen formation, comprising the steps of:

a) rotating at least the drill string to form a borehole into the earthen formation;

b) causing a magnetorheological (MR) fluid to flow through a passage in an MR valve, the MR valve having at least one coil, the MR valve having associated therewith a limiting hysteresis loop relating a strength of the magnetic field in said MR valve to a current supplied to said coil;

c) supplying a varying current to said coil so as to subject said MR fluid in said MR valve to a varying magnetic field created by said coil;

d) determining a magnetization history of said MR valve as said current supplied to said coil varies, the magnetization history being based on a measurement of the varying current and a determination of the strength of said magnetic field created by said varying current, said strength of said magnetic field based on information representative of said limiting hysteresis loop associated with said MR valve;

e) determining the current to be supplied to said coil that will result in a desired magnetic field using said magnetization history of said MR valve determined in step d); and f) supplying said current determined in step e) to said coil so as to substantially obtain said desired magnetic field to dampen vibration of the downhole portion of the drill string, wherein said magnetization history of said MR valve determined in step d) comprises a first stack of first sets of data points, each of said first sets of data points comprising a first data point that is representative of a current that was supplied to said coil and a second data point that is representative of the magnetic field that resulted from the supply of said current, and wherein determining said current to be supplied to said coil in step e) further comprises the steps of:

g) copying said first stack of first data points so as to create a second stack of data points;

h) adding one or more second sets of data points to said second stack of data points, each of said second sets of data points added to said second stack of data points comprising a selected test current and the magnetization expected to result if said test current were supplied to said coil; and i) performing a binary search of said data points in said second stack after said one or more second sets of data points have been added to said second stack so as to determine the current to be supplied to said coil that will result in said desired magnetic field.

2. The method of damping vibration according to claim 1, wherein the current that was supplied to said coil of which each of said first data points is representative of the current at which the change in current supplied to said coil reversed direction.

3. The method of damping vibration according to claim 1, further comprising the steps of:

j) supplying a further current to said coil after step f) that is different from said current supplied to said coil in step f);

k) updating said magnetization history of said MR valve determined in step d) so as to include the current supplied to said coil in step f) only if the current supplied to said coil in step j) represented a reversal in a direction of the change in current supplied to said coil when compared to direction of the change in the current supplied to said coil that resulted in said current supplied to said coil in step f).

4. The method of damping vibration according to claim 1, further comprising the step of: j) updating said magnetization history of said MR valve determined in step d) based on the current supplied to said coil in step f).

5. The method of damping vibration according to claim 1, wherein said information representative of said limiting hysteresis loop used in step d) comprises information representative of the magnetic field created in said MR valve versus the current supplied to said coil as said current is increased to the saturation current and then decreased to zero.

6. The method of damping vibration according to claim 1, wherein the step of supplying the varying current to said coil in step c) creates a remanent magnetization in at least one component of said MR valve, and wherein the current supplied to said coil in step f) results in reducing said remanent magnetization.

7. The method of damping vibration according to claim 6, wherein said current supplied to said coil in step f) that results in reducing said remanent magnetization is not an alternating current.

8. The method of damping vibration according to claim 6, wherein the current supplied to said coil in step f) results in substantially eliminating said remanent magnetization.

9. The method of damping vibration according to claim 6, wherein the current supplied to said coil in step f) results in reducing but not substantially eliminating said remanent magnetization.

10. A method of damping vibration in a downhole portion of a drill string, said drill string comprising a magnetorheological (MR) valve containing an MR fluid subjected to a magnetic field created by at least one coil, said MR fluid flowing through a passage formed in said MR valve, the method comprising the steps of:

a) supplying current to said at least one coil of said MR valve for a first period of time so as to create a first magnetic field that alters the viscosity of said MR fluid, said first magnetic field being sufficient to induce a first remanent magnetization in at least one component of said MR valve proximate said passage;

b) substantially de-energizing said at least one coil for a second period of time following said first period of time so as to operate said MR valve using said first remanent magnetization in said at least one component of said MR valve to create a second magnetic field that alters the viscosity of said MR fluid;

c) at least partially demagnetizing said at least one component of said MR valve so as to reduce said first remanent magnetization of said at least one component of said MR valve to a second remanent magnetization, said at least partially demagnetizing step comprising the steps of:

(1) determining a magnetization history of said MR valve as said current supplied to said at least one coil varies by measuring said varying current and calculating a strength of said magnetic field created by said varying current, said strength of said magnetic field determined using information representative of a limiting hysteresis loop associated with said MR valve;

(2) determining the current to be supplied to said coil that will result in at least partially demagnetizing said at least one component using said magnetization history of said MR valve determined in step c)(1);

(3) supplying said current determined in step c)(2) to said coil so as to at least partially demagnetize said at least one component; and d) operating said MR valve for a third period of time after said at least partial demagnetization in step c).

11. The method of damping vibration according to claim 10 wherein the step of supplying the current includes damping a vibration in the drill string.

12. The method of damping vibration according to claim 11, further comprising the step of causing the drill string to rotate so to form a borehole into an earthen formation.

13. The method of damping vibration according to claim 10, wherein the step of supplying the current includes supplying a first current to the at least one coil, and the method further comprises supplying a second current to the at least one coil that is different from the first current.

14. The method of damping vibration according to claim 13, wherein the step of determining the magnetization history of said MR valve further comprises:

measuring the first current that was supplied to said at least one coil;

measuring the second current supplied to said at least one coil; and determining the variance among the first current and the second current, wherein the strength of the magnetic field is based on the determined variance among the first current and the second current.

15. A magnetorheological (MR) valve assembly for damping vibration of a drill bit for drilling into an earthen formation, comprising:

at least one coil to which current is supplied and an MR fluid that flows through a passage formed in said MR valve proximate said coil, the current supplied to said coil varying so as to subject said MR fluid in said MR valve to a varying magnetic field created by said coil;

a computer memory including stored thereon information representative of a limiting hysteresis loop relating the strength of the magnetic field in said MR valve to the current supplied to said coil;

a computer processor configured to determine: i) a magnetization history of the MR valve as the current supplied to the coil varies, the magnetization history of said MR valve based on a measurement of the varying current and a determination of the strength of said magnetic field created by the varying current, the strength of the magnetic field based on the information representative of the limiting hysteresis loop stored in the computer memory, and ii) the current to be supplied to the at least one coil that will result in a desired magnetic field using said magnetization history of said MR valve, wherein said magnetization history of said MR valve comprises a first stack of first sets of data points, each said first set of data points comprising a first data point that is representative of a current that was supplied to said coil and a second data point that is representative of the magnetic field that resulted from the supply of said current;

wherein said computer processor is configured to, when executing instructions to determine the current to be supplied to the at least one coil:

A) copy said first stack of first data points so as to create a second stack of data points;

B) add one or more second sets of data points to said second stack of data points, each of said second sets of data points added to said second stack comprising a selected test current and the magnetization expected to result if said test current were supplied to said coil; and C) perform a binary search of said data points in said second stack after said one or more second sets of data points have been added to said second stack so as to determine the current to be supplied to said coil that will result in said desired magnetic field.

16. The MR valve assembly according to claim 15, wherein the current that was supplied to said coil of which each of said first data points is representative is the current at which the change in current supplied to said coil reversed direction.

17. The MR valve assembly according to claim 15, wherein said MR valve assembly further comprises:

a first member capable of being mechanically coupled to said drill bit so that said first member is subjected to vibration from said drill bit;

a second member, said first member mounted so as to move relative to said second member, said first and second members defining a first chamber and a second chamber for holding said magnetorheological fluid, said passage through which said MR fluid flows disposed between said first and second members and placing said first and second chambers in fluid communication, wherein at least a portion of one of said first and second members is made from a material having a relative magnetic permeability of at least about 7000, and at least a portion of the other of said first and second members being capable of having induced therein a remanent magnetic field in response to said magnetic field generated by said at least one coil that is sufficient to operate said MR valve when said coil is de-energized, said portion of said other of said first and second members in which said remanent magnetic field is induced being made from a material having a maximum remanent magnetization of at least about 12,000 Gauss.

18. The MR valve assembly according to claim 15, further comprising:

a first member capable of being mechanically coupled to said drill bit so that said first member is subjected to vibration from said drill bit;

a supply of magnetorheological fluid; and a second member, said first member mounted so as to move relative to said second member, the first and second members defining a first chamber, a second chamber, and a passage placing said first and second chambers in fluid communication with each other, the first and second chambers configured to hold the magnetorheological fluid, wherein at least a portion of one of said first and second members being capable of having induced therein a remanent magnetic field in response to said magnetic field generated by said at least one coil that is sufficient to operate said MR valve when said at least one coil is de-energized.

19. The magnetorheological (MR) valve assembly of claim 18, wherein the measurement of the varying current is a variance in current among a first current supplied to said coil and a second current supplied to said coil, and wherein the strength of said magnetic field is based on the variance in the current among the first and second current supplied to the at least one coil.

20. The MR valve assembly according to claim 18, wherein at least a portion of one of the first and second members is made from a material having a relative magnetic permeability of at least about 7000, and at least a portion of the other of said first and second members is made from a material having a maximum remanent magnetization of at least about 12,000 Gauss.

21. A magnetorheological (MR) valve assembly for damping vibration of a drill bit for drilling into an earthen formation, comprising:

a) at least one coil to which current is supplied and an MR fluid that flows through a passage formed in said MR valve proximate said coil, the current supplied to said coil varying so as to subject said MR fluid in said MR valve to a varying magnetic field created by said coil;

b) memory means in which is stored information representative of a limiting hysteresis loop relating a strength of the magnetic field in said MR valve to the current supplied to said coil;

c) history determining means for determining the magnetization history of said MR valve as said current supplied to said coil varies by measuring said varying current and calculating the strength of said magnetic field created by said varying current, said strength of said magnetic field determined using said information representative of said limiting hysteresis loop stored in said memory means; wherein the determined magnetization history of said MR valve includes a first stack of first sets of data points, each said first set of data points comprising a first data point that is representative of a current that was supplied to said coil and a second data point that is representative of the magnetic field that resulted from the supply of said current, and d) current determining means for determining the current to be supplied to said coil that will result in a desired magnetic field using said magnetization history of said MR valve that also includes a means to:

1) copy said first stack of first data points so as to create a second stack of data points;

2) add one or more second sets of data points to said second stack of data points, each of said second sets of data points added to said second stack comprising a selected test current and the magnetization expected to result if said test current were supplied to said coil; and 3) perform a binary search of said data points in said second stack after said one or more second sets of data points have been added to said second stack so as to determine the current to be supplied to said coil that will result in said desired magnetic field.

22. The MR valve assembly according to claim 21, wherein the current that was supplied to said coil of which each of said first data points is representative is the current at which the change in current supplied to said coil reversed direction.

23. The MR valve assembly according to claim 21, wherein said MR valve assembly further comprises:

a first member capable of being mechanically coupled to a drill bit so that said first member is subjected to vibration from said drill bit; and a second member, said first member mounted so as to move relative to said second member, said first and second members defining a first chamber and a second chamber for holding said magnetorheological fluid, said passage through which said MR fluid flows disposed between said first and second members and placing said first and second chambers in fluid communication, wherein at least a portion of one of said first and second members are made from a material having a relative magnetic permeability of at least about 7000, and at least a portion of the other of said first and second members being capable of having induced therein a remanent magnetic field in response to said magnetic field generated by said at least one coil that is sufficient to operate said MR valve when said coil is de-energized, said portion of said other of said first and second members in which said remanent magnetic field is induced being made from a material having a maximum remanent magnetization of at least about 12,000 Gauss.

24. A method of damping vibration in a downhole portion of a drill string drilling into an earthen formation, comprising the steps of:

a) rotating at least the drill string to form a borehole into the earthen formation;

b) causing a magnetorheological (MR) fluid to flow through a passage in an MR valve, the MR valve having at least one coil, the MR valve having associated therewith a limiting hysteresis loop relating the strength of the magnetic field in said valve to the current supplied to said coil;

c) supplying a varying current to said coil so as to subject said MR fluid in said MR valve to a varying magnetic field created by said coil;

d) determining the magnetization history of said MR valve as said current supplied to said coil varies, the magnetization history being based on a measurement of the varying current and a determination of the strength of said magnetic field created by said varying current, said strength of said magnetic field based on information representative of said limiting hysteresis loop associated with said MR valve;

e) determining the current to be supplied to said coil that will result in a desired magnetic field using said magnetization history of said MR valve determined in step (c);

f) supplying said current determined in step e) to said coil so as to substantially obtain said desired magnetic field to dampen vibration of the downhole portion of the drill string, wherein said magnetization history of said MR valve determined in step d) comprises first sets of data points, each of said first sets of data points comprising a first data point that is representative of a current that was supplied to said coil and a second data point that is representative of the magnetic field that resulted from the supply of said current, and wherein determining said current to be supplied to said coil comprises performing a binary search of said first sets of data points.

g) supplying a further current to said coil after step f) that is different from said current supplied to said coil in step f); and h) updating said magnetization history of said MR valve determined in step d) so as to include the current supplied to said coil in step f) only if the current supplied to said coil in step g) represented a reversal in the direction of the change in current supplied to said coil when compared to direction of the change in the current supplied to said coil that resulted in said current supplied to said coil in step f).

25. The method of damping vibration according to claim 24, further comprising the step of: i) updating said magnetization history of said MR valve determined in step d) based on the current supplied to said coil in step f).

26. The method of damping vibration according to claim 24, wherein said information representative of said limiting hysteresis loop used in step d) comprises information representative of the magnetic field created in said MR valve versus the current supplied to said coil as said current is increased to the saturation current and then decreased to zero.

27. The method of damping vibration according to claim 24, wherein the step of supplying a varying current to said coil in step c) creates a remanent magnetization in at least one component of said MR valve, and wherein the current supplied to said coil in step f) results in reducing said remanent magnetization.

* * * * *